US008047190B2

(12) United States Patent
Kaakkola et al.

(10) Patent No.: US 8,047,190 B2
(45) Date of Patent: Nov. 1, 2011

(54) PAINTBALL LOADER

(75) Inventors: Eero Kaakkola, San Diego, CA (US); Bryon Benini, San Marcos, CA (US); Gerald R. Parks, Chula Vista, CA (US)

(73) Assignee: Dye Precision, Inc., San Diego, CA (US)

( * ) Notice: Subject to any disclaimer, the term of this patent is extended or adjusted under 35 U.S.C. 154(b) by 415 days.

(21) Appl. No.: 12/256,434

(22) Filed: Oct. 22, 2008

(65) Prior Publication Data

US 2010/0095942 A1 Apr. 22, 2010

Related U.S. Application Data

(60) Provisional application No. 61/106,973, filed on Oct. 20, 2008.

(51) Int. Cl.
*F41A 9/61* (2006.01)

(52) U.S. Cl. ..... 124/48; 124/1; 124/45; 124/51.1

(58) Field of Classification Search ..... 124/1, 45, 124/48, 51.1, 49
See application file for complete search history.

(56) References Cited

U.S. PATENT DOCUMENTS

| | | | | |
|---|---|---|---|---|
| 3,610,223 | A | 10/1971 | Green | |
| 5,722,383 | A * | 3/1998 | Tippmann et al. | 124/76 |
| 5,749,797 | A | 5/1998 | Sunseri et al. | |
| 5,794,606 | A | 8/1998 | Deak | |
| 5,816,232 | A * | 10/1998 | Bell | 124/51.1 |
| 5,954,042 | A | 9/1999 | Harvey | |
| 6,109,252 | A * | 8/2000 | Stevens | 124/51.1 |
| 6,327,953 | B1 | 12/2001 | Andresen | |
| 6,415,781 | B1 | 7/2002 | Perrone | |
| 6,502,567 | B1 | 1/2003 | Christopher et al. | |
| 6,526,955 | B1 | 3/2003 | Juan | |
| 6,684,873 | B1 * | 2/2004 | Anderson et al. | 124/82 |
| 6,739,323 | B2 | 5/2004 | Tippmann, Jr. | |
| 7,017,569 | B2 * | 3/2006 | Jong | 124/52 |
| 7,222,617 | B2 | 5/2007 | Andresen | |
| 7,234,456 | B2 | 6/2007 | Andresen | |
| 7,270,121 | B2 | 9/2007 | Lubben | |

(Continued)

FOREIGN PATENT DOCUMENTS

DE 199 50 288 A1 4/2001

OTHER PUBLICATIONS

European Search Report & Written Opinion, Application No. EP 10 16 4831, dated Sep. 27, 2010, 7 pgs.

(Continued)

*Primary Examiner* — Alvin Hunter
*Assistant Examiner* — Scott Young
(74) *Attorney, Agent, or Firm* — Knobbe Martens Olson & Bear LLP

(57) ABSTRACT

A paintball loader which feeds paintballs to a paintball marker has a rotor body and a drive motor for rotating the rotor body. The paintball loader can include a latch member for selectively securing an upper shell member to a lower shell member. The paintball loader can include a ramp member inside the upper and lower shell members. The ramp member moves between a first or flattened position and a second or raised position to facilitate operation of the loader. The components of the loader are designed so that assembly/disassembly is performed with few, if any, tools to facilitate cleaning and/or maintenance.

33 Claims, 30 Drawing Sheets

U.S. PATENT DOCUMENTS

| | | | | |
|---|---|---|---|---|
| 7,275,530 | B2 * | 10/2007 | Deak | 124/73 |
| 7,568,478 | B2 * | 8/2009 | Hedberg | 124/51.1 |
| 7,591,260 | B1 * | 9/2009 | Mu | 124/51.1 |
| 7,654,255 | B2 * | 2/2010 | Spicer | 124/51.1 |
| 7,832,389 | B2 * | 11/2010 | Christopher | 124/51.1 |
| 2002/0059927 | A1 * | 5/2002 | Woods, Sr. | 124/45 |
| 2002/0092513 | A1 | 7/2002 | Christopher et al. | |
| 2006/0081233 | A1 | 4/2006 | Andresen | |
| 2006/0086347 | A1 | 4/2006 | Hedberg | |
| 2007/0012304 | A1 | 1/2007 | van Dorsser et al. | |
| 2007/0295319 | A1 * | 12/2007 | Carter et al. | 124/49 |
| 2008/0017178 | A1 | 1/2008 | Marques et al. | |

OTHER PUBLICATIONS

Archon Tacamo Gravity Paintball Hopper. Image of paintball hopper on webpage URL:http://paintball-hoppers.com/archon-tacamo-gravity-paintball-hopper/. Retrieval date: May 25, 2010. The Archon Tacamo Gravity Paintball Hopper can be considered prior art for purposes of the present application.

* cited by examiner

PAINTBALL LOADER

RELATED APPLICATIONS

This application claims priority under 35 U.S.C. §119(e) to U.S. Provisional Patent Application Ser. No. 61/106,973 (filed Oct. 20, 2008) which is hereby expressly incorporated by reference in its entirety.

BACKGROUND OF THE INVENTION

1. Technical Field

The present invention relates to a paintball loader, and more specifically to a paintball loader which rapidly and forcibly feeds paintballs to a paintball marker.

2. Background of the Disclosure

This disclosure relates to loaders for pneumatic paintball markers. Markers are typically used for target practice and in mock war games. The markers can use a compressed gas, such as air or nitrogen, to propel spherical projectiles called paintballs out of the barrel of the device. Paintballs are typically comprised of a colored liquid enclosed in a fragile gelatin casing. The paintballs can be designed to rupture upon impact to mark the target.

Typically, conventional loaders include a housing which is placed on an upper portion of the marker. The housing can be shaped to hold a large amount of paintballs. An outlet tube is typically located at the bottom of the housing through which the paintballs drop either by the force of gravity or by the force of a paintball feeding mechanism. The outlet tube can lead to the marker, where the paintballs are propelled outwardly from the marker by compressed air.

The main reason to provide a feeding mechanism is that the feeding of paintballs only by force of gravity does not always work satisfactorily. Firstly a high rate of fire, which is essential for the player, can not be achieved merely by force of gravity. Secondly the force of gravity only works when the marker is held in an upright or close to upright position, and consequently there is no feeding at all when the marker is tilted in certain angles since the paintballs then do not fall into the outlet tube. This problem can be avoided by providing a paintball loader mechanism which by force inputs the paintballs into the outlet tube and into the marker.

SUMMARY OF THE INVENTION

In view of the foregoing, a need exists for an improved paintball loader for a pneumatic marker. An aspect of the disclosure is directed to a paintball loader for feeding one or more paintballs into a paintball marker. In some embodiments, the loader can comprise a rotor member having at least one rotor fin configured to rotate about an axis, a rotor arm member having an opening and being configured to rotate about substantially the same axis, and a drive motor configured to rotate the rotor member and the rotor arm member.

Another aspect of the disclosure is directed to a paintball loader comprising a housing and a ramp member supported within the housing and being configured to move from a first position to a second position.

Another aspect of the disclosure is directed to a paintball loader for feeding one or more paintballs into a paintball marker, the loader comprising a housing, at least a portion of the housing having an opening through which the one or more paintballs are fed to the paintball marker, a rotor member having a plurality of rotor fins configured to rotate about an axis, a rotor arm member being configured to rotate about substantially the same axis, at least a portion of the rotor arm member being disposed above the opening and below the rotor member, and a drive motor configured to rotate the rotor member and the rotor arm member.

BRIEF DESCRIPTION OF THE DRAWINGS

The present inventions will now be described in more detail with reference to the following drawings, which show preferred embodiments of the inventions and in which.

DETAILED DESCRIPTION OF THE PREFERRED EMBODIMENTS

Figure 1:
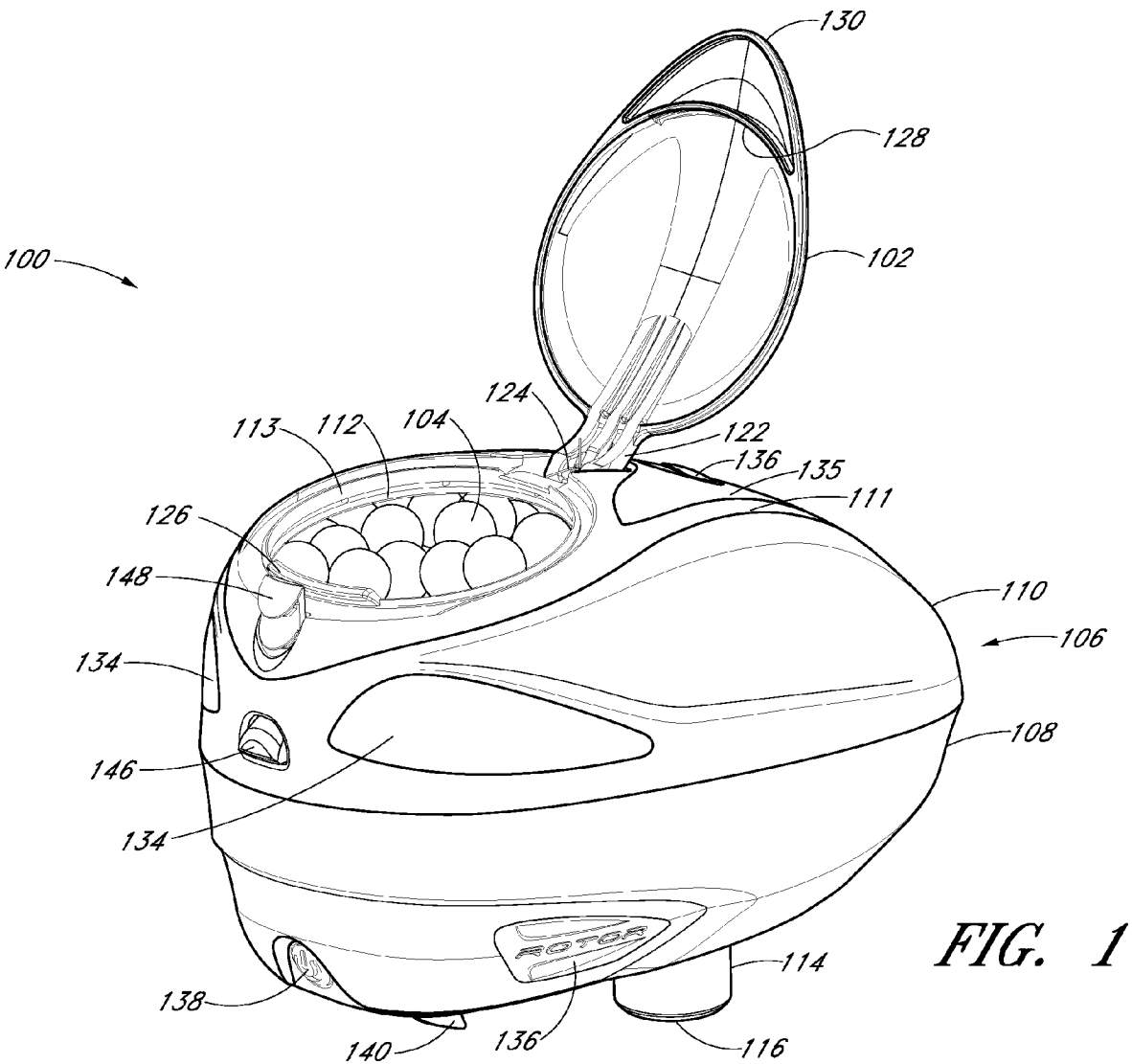
FIG. 1 is a perspective view of an embodiment of a loader, showing a lid member in an open position and the loader having paintballs therein.
Figure 3:
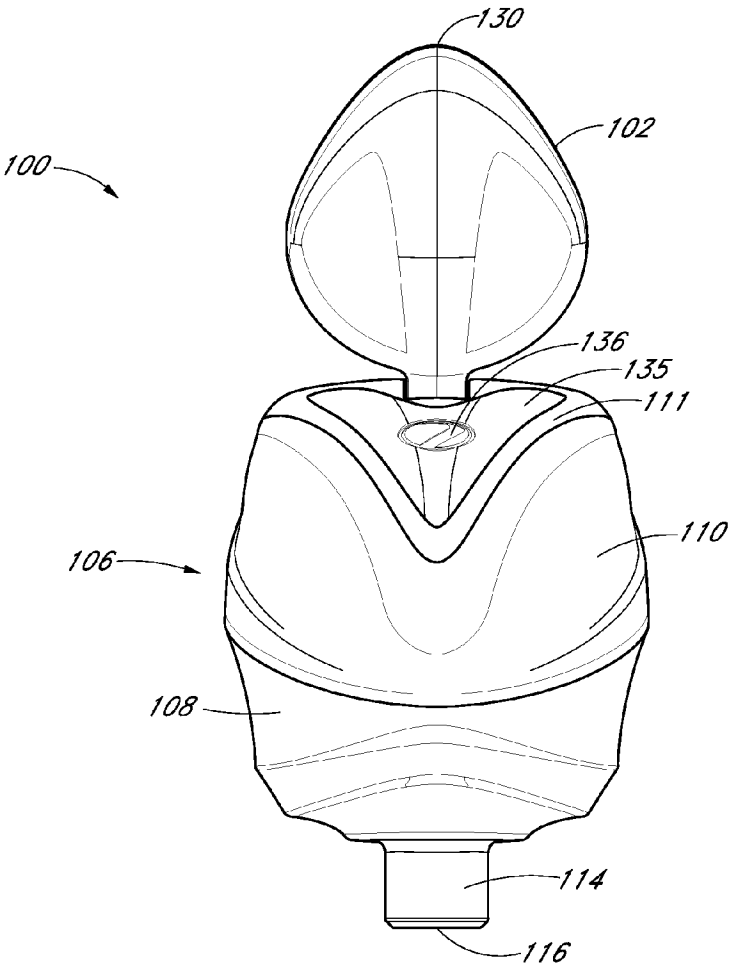
FIG. 3 is a back view of the embodiment of the loader shown in FIG. 1, showing the lid member in an open position.
Figure 2:
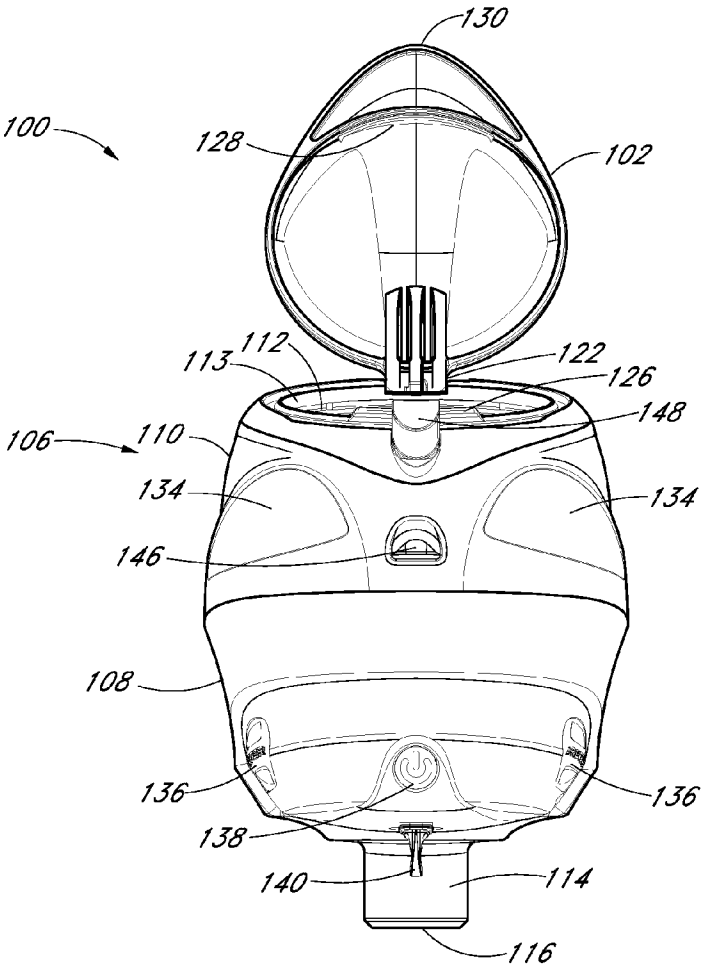
FIG. 2 is a front view of the embodiment of the loader shown in FIG. 1, showing the lid member in an open position.
Figure 5:
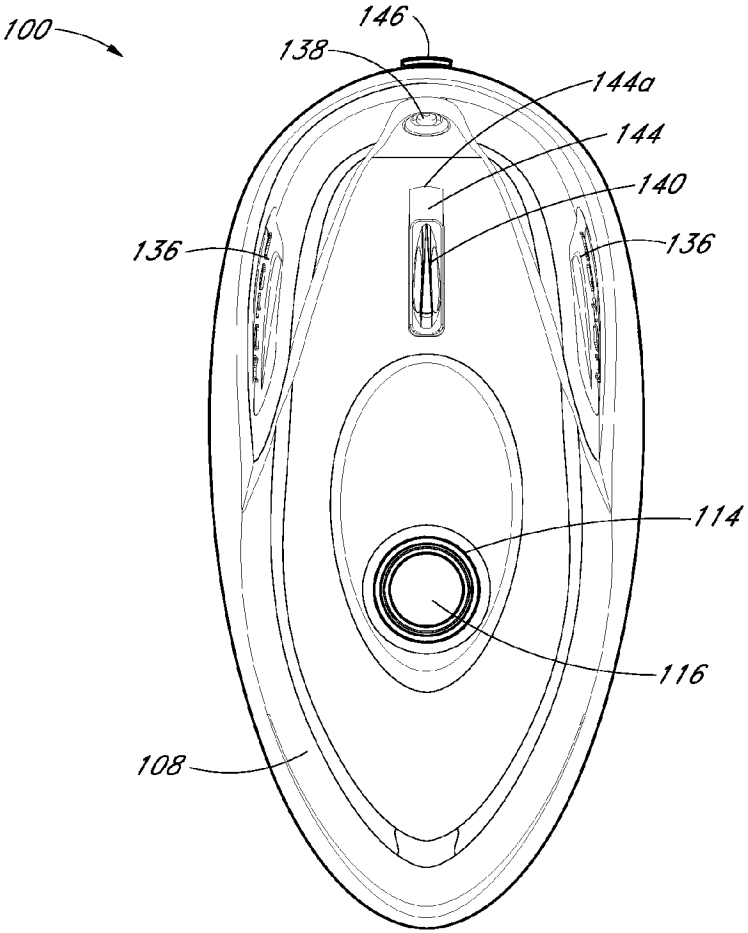
FIG. 5 is a bottom view of the embodiment of the loader shown in FIG. 1.
Figure 4:
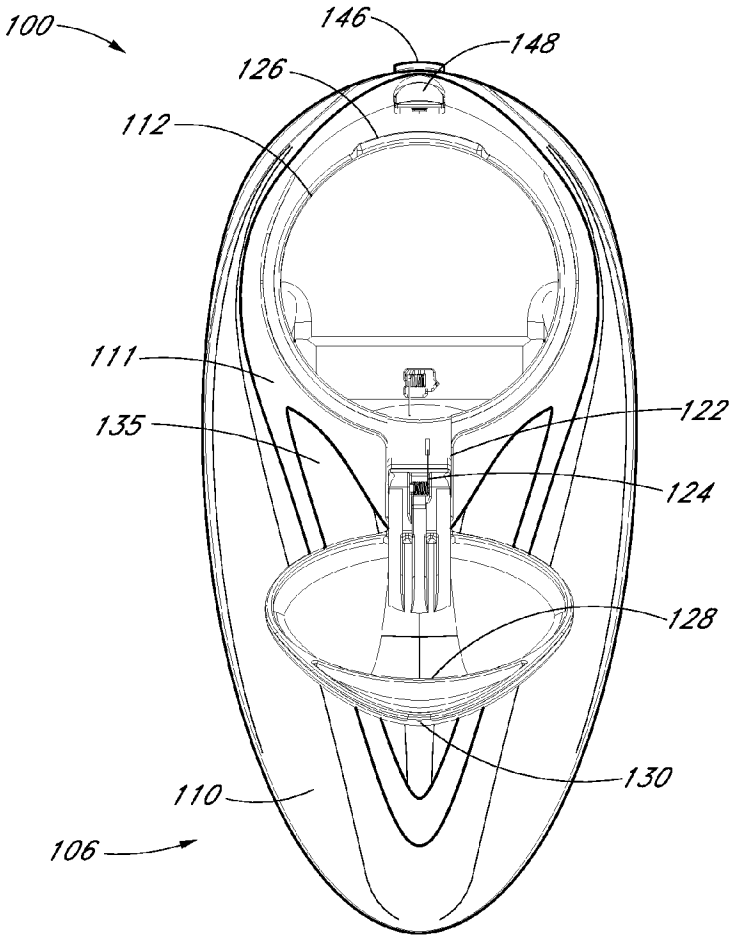
FIG. 4 is a top view of the embodiment of the loader shown in FIG. 1, showing the lid member in an open position.
Figure 6:
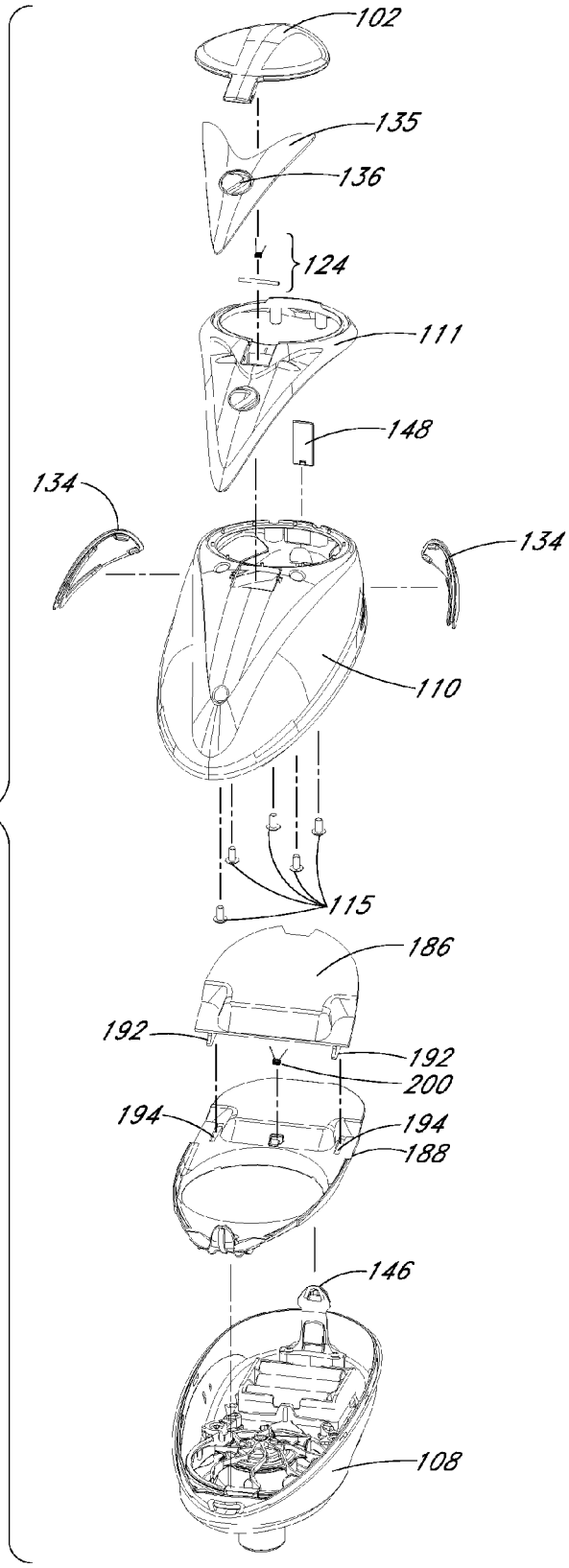
FIG. 6 is a partial exploded assembly view of the embodiment of the loader shown in FIG. 1.
Figure 7:
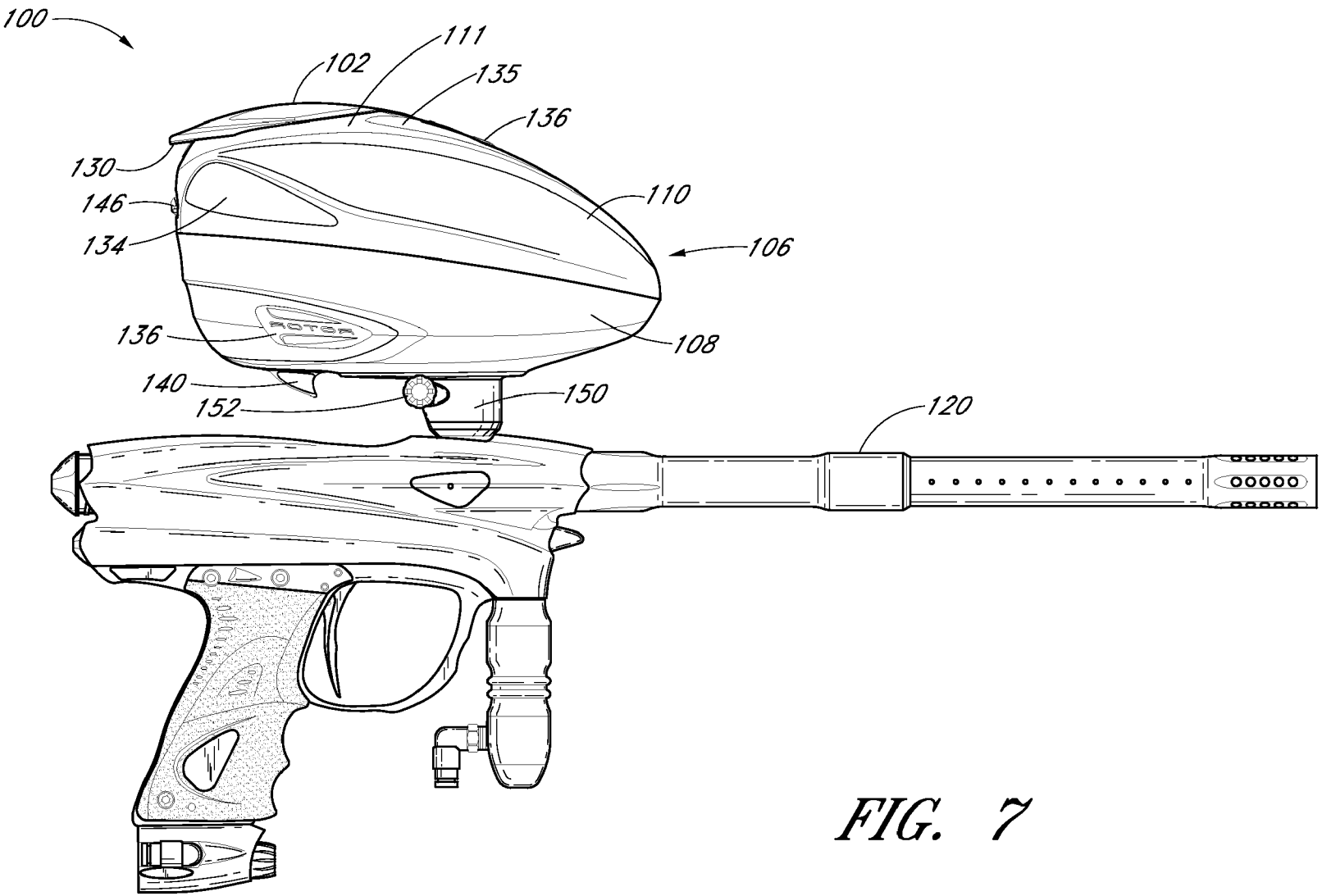
FIG. 7 is a side view of the embodiment of the loader shown in FIG. 1, mounted on an embodiment of a marker, showing the lid member in a closed position.

FIGS. 1-3 are a perspective view, front view, and back view, respectively, of an embodiment of a loader 100, showing the lid member 102 in an open position. FIG. 1 illustrates the loader 100 having paintballs 104 therein. FIGS. 4-5 are top and bottom views, respectively, of the embodiment of the loader 100 shown in FIG. 1, again showing the lid member 102 in an open position. FIG. 6 is an exploded assembly view of the embodiment of the loader 100 shown in FIG. 1. FIG. 7 is a side view of the embodiment of the loader 100 shown in FIG. 1, mounted on an embodiment of a marker 120, showing the lid member 102 in a closed position.

With reference to FIGS. 1-7, the loader 100 can comprise a casing 106 having a lower shell member or first body member 108 and an upper shell member or a second body member 110. The upper shell member 110 can have an opening 112 formed therein, sized and configured to receive a plurality of paintballs 104 therethrough. Additionally, the lower shell portion 108 can comprise a boss 114 having an opening or passageway 116 formed therein, the boss 114 and opening 116 being configured to provide a path for paintballs 104 from the loader 102 marker, such as the marker 120 illustrated in FIG. 7.

In some embodiments, the loader 100 can also have a carrier member 111 that can be supported by the upper case member 110. In some embodiments, the carrier member 111 can be removed to allow a user to easily change the lid member 102, the rapid feed member (which will be described in greater detail below), or any other components supported by the carrier member 111. The carrier member 111 can have an opening 113 formed therein that can be aligned with and be substantially the same size as the opening 112 formed in the upper shell member 110. The carrier member 111 can be supported by the uppercase member 110 using fasteners 115 (illustrated in FIG. 6), rivets, snaps, adhesive, or any other suitable fastening mechanisms or methods.

In some embodiments, the lid member 102 can be supported by the carrier member 111. In particular, the lid member 102 can have a hinge portion 122 that is configured to be rotatably supportable by the carrier member 111 so that the lid member 102 can be rotated between an open position (such as is illustrated in FIG. 1) and a closed position (such as illustrated in FIG. 7). In some embodiments, although not necessary, the loader 100 can have a spring mechanism 124 (which can include a support rod) configured to bias the lid member 102 in an open position. In some embodiments, the lid member 102 can be formed from a substantially transparent material, such as a plastic material, to allow a user to view at least a portion of the inside of the casing 106.

The loader 100 can be configured so that the lid member 102 is selectively securable or lockable in a closed position so that paintballs 104 are securely held within the loader 100 during use of the loader 100. For example, in some embodiments, the carrier member 111 and the lid member 102 can each have latched members 126, 128, respectively, that are configured to selectively block or snap the lid member 102 in the closed position when a user exerts a force on the lid member 102 so as to engage or secure the latch members 126, 128 to one another. In some embodiments, the loader 100 can be configured such that a user need only exert a force on the overhanging portion 130 of the lid member 102 in a direction away from the carrier member 111 to disengage the lid member 102 from the latch mechanism 126 that can be formed on the carrier member 111, hence disengaging the latch members 126, 128 from one another.

The loader 100 can be configured such that the lid member 102 is biased toward a closed position. For example, the loader 100 or the lid member 102 (or a suitable variant of the lid member 102) can include a spring mechanism that biases the lid member toward the closed position. In some embodiments, the biasing force exerted by the spring mechanism on the lid member toward the closed position is adequate to prevent the lid member from inadvertently opening during operation of the loader 100. In some embodiments, the biasing force exerted by the spring member is adequate so that a separate latch member to secure the lid member in a closed position is not required.

Some embodiments of this configuration may require a user to hold the lid member in an open position while loading paintballs into the loader 100. In some embodiments, however, the loader 100 or the lid member can have detents or other suitable mechanisms (such as cam-type hinge arrangement) that are configured to secure the lid member in an open position against the bias of the spring member such that a user is not required to hold the lid member in an open position while loading paintballs. Thus, in some embodiments of this arrangement, the spring member can exert a bias on the lid member that can prevent the lid member from inadvertently opening during operation of the loader, while the loader 100 or the lid member are also configured to hold the lid member in an open position after a user has at least partially opened the lid member.

In some embodiments, at least a portion of the loader 100 can be transparent or translucent to allow a user to view at least a portion of the inside of the loader 100 so as to, for example, determine the approximate number of remaining paintballs within the loader 100. For example, the loader 100 can have a pair of generally transparent or translucent inserts 134 supported by the upper shell member 110, configured to allow a user to view at least a portion of the inside of the casing 106. Additionally, in some embodiments, a cover plate 135 can be supported by the carrier member 111. In some embodiments, the loader 100 can have one or more emblems 136 positioned more supported at various locations by the casing 106 and/or carrier member 111. The inserts 134, cover plate 135, and/or emblems 136 can be supported by the casing 106 using fasteners, rivets, snaps, adhesive, or any other suitable fastening mechanisms or methods.

The loader member 100 can have a power switch 138 supported by the casing 106, in particular, supported by the lower shell member 108. As will be described in greater detail below, the power switch 138 can be configured to switch the power for the loader 100 between the on and off positions.

Additionally, in some embodiments, the loader 100 can have a jam release trigger member or actuator 140 that, as will be described in greater detail below, can be linked to the rotor system on the inside of the loader 100 and can be configured to clear the paintball jams that may occur within the loader 100. In some embodiments, as most clearly illustrated in FIG. 5 (and, as will be described below, FIG. 28), the trigger member 140 can be supported by the lower shell member 108 so that the trigger member 140 can translate within an opening or channel 144 formed in the lower shell member 108. As will be described, the loader 100 can be configured so that a user can clear balls jammed within the loader 100 by pulling or sliding the trigger member 140 toward the front portion 144*a* of the channel 144.

With reference to FIG. 1, the loader 100 can have a latch member 146 that can be configured to selectively secure the upper shell member 110 to the lower shell member 108 when the latch member 146 is in the closed position, as illustrated in FIG. 1. In some embodiments, a user can release the latch member 146 by pushing or depressing the latch member 146 toward the inside of the casing 106, allowing the user to then disengage the upper shell member 110 from the lower shell member 108 to access to the inside of the loader 100, as desired.

In some embodiments, the loader 100 can have a locking tab member 148 that can be configured to selectively lock the latching mechanism 146 to prevent a user from inadvertently depressing the latch member 146 and, hence, inadvertently disengaging the upper shell member 110 from the lower shell member 108 during operation. In particular, if the locking tab member 148 is slid to the open position, as is illustrated in FIG. 1, the latch member 146 can then be depressed. However, if the locking tab member 148 is slid downward, so as to overlap and abut against the back, inside surface of the latching mechanism 146, the latching mechanism 146 will then generally be in a locked configuration such that a user will be inhibited from depressing the latching mechanism 146 and disengaging the upper shell member 110 from the lower shell member 108. Again, in this configuration, the locking tab member 148 can be configured to selectively secure the latching mechanism 146 in the latched or locked position.

As mentioned, FIG. 7 is a side view of the embodiment of the loader 100 shown in FIG. 1, mounted on an exemplary marker 120, showing the lid member 102 in a closed position. As illustrated therein, the marker 120 can have a feedneck supporting member 150 configured to receive the boss 114 formed on the loader 100. In some embodiments, the feedneck 150 on the marker 120 can have a tightening mechanism 152 configured to constrict the feedneck 150 around the boss 114 formed on the loader 100. For example, a clamp mechanism or a collar and lever mechanism may be employed to secure the loader 100 to the marker 120. In this assembled configuration, the balls fed by the loader 100 through the opening 116 and the boss 114 can enter the marker 120 through the feedneck 150 formed on the marker 120, to be ultimately deployed by the marker 120 at the desired target.

Figure 8:
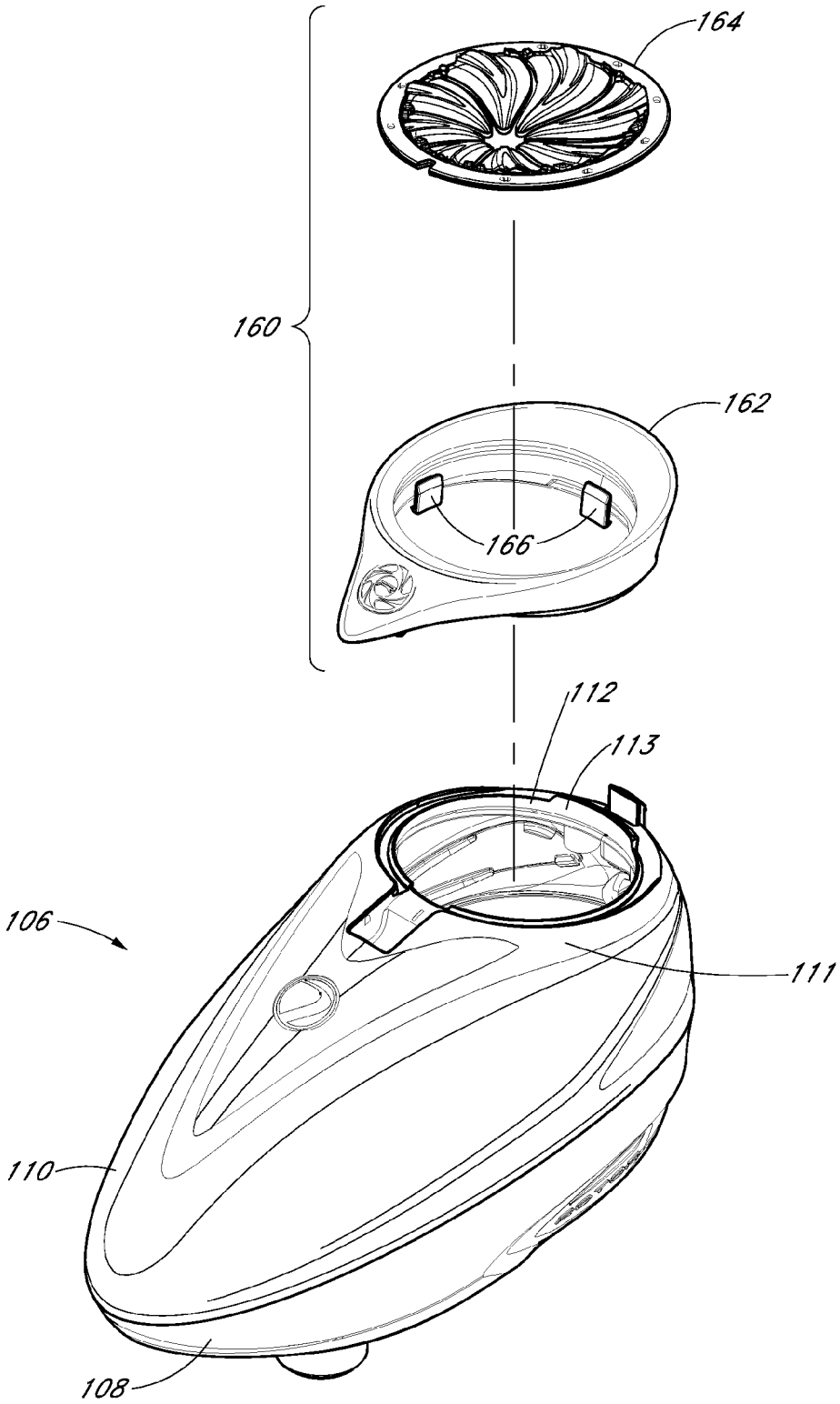
FIG. 8 is a partial exploded assembly view of another embodiment of a loader having a rapid feed attachment supported thereby.
Figure 10:
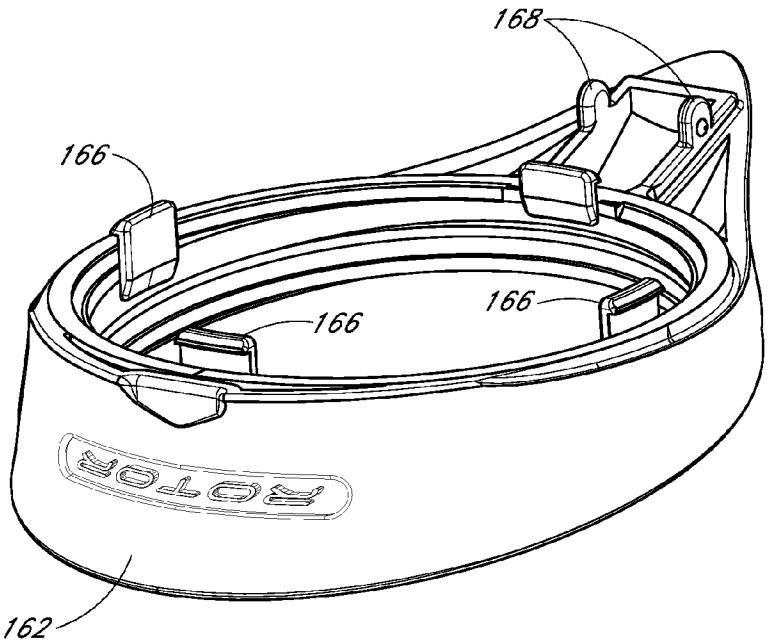
FIG. 10 is a perspective view of the bottom portion of the embodiment of the extension member illustrated in FIG. 8.
Figure 9:
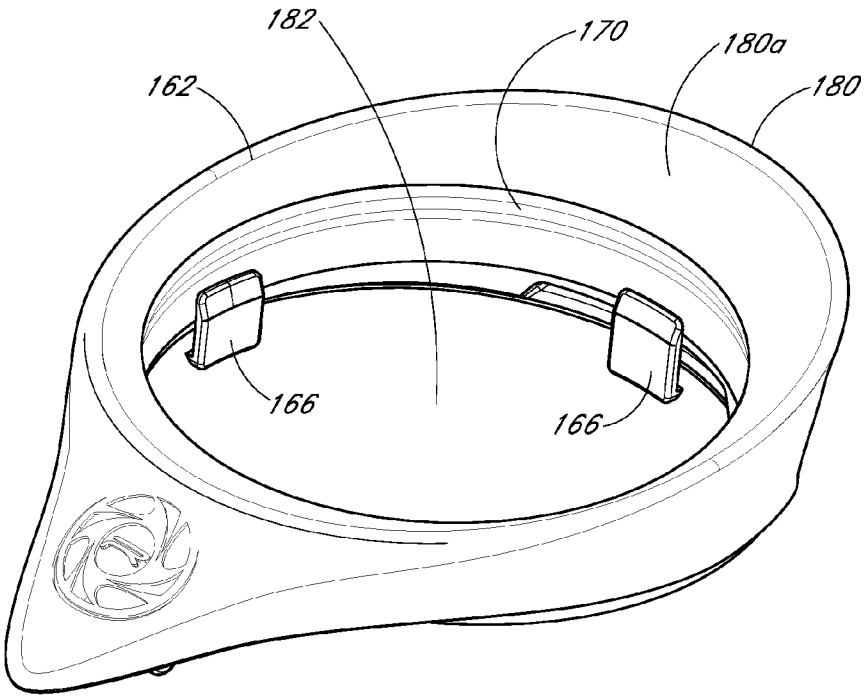
FIG. 9 is a perspective view of the top portion of the embodiment of the extension member illustrated in FIG. 8.
Figure 12:
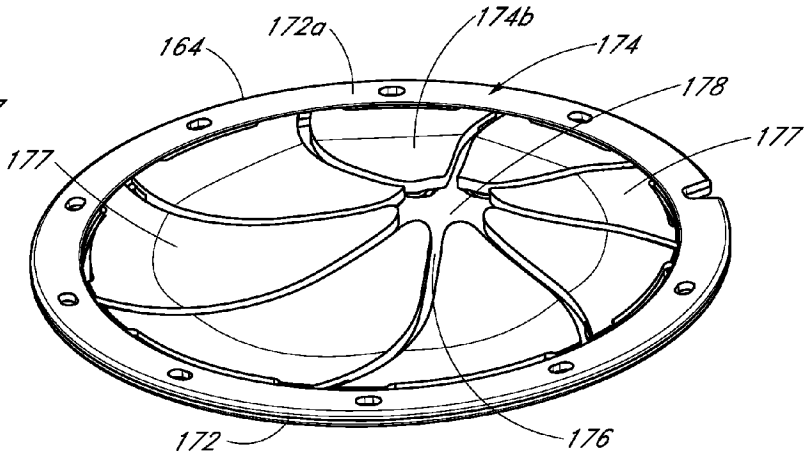
FIG. 12 is a perspective view of the embodiment of the rapid feed valve member illustrated in FIG. 8.
Figure 11:
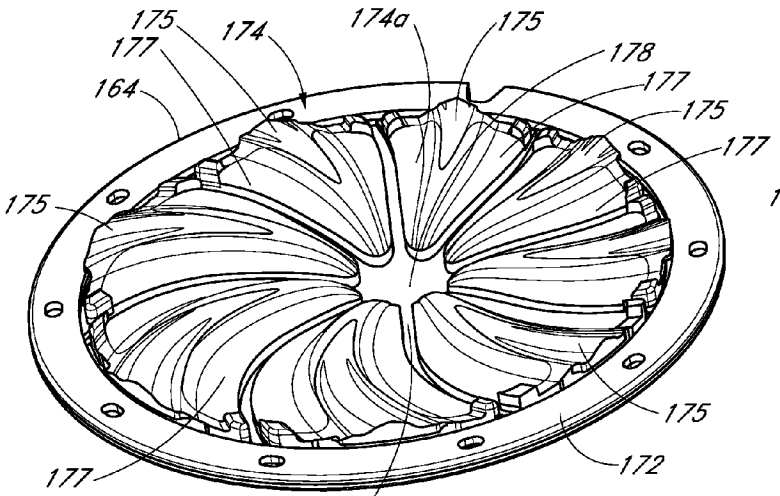
FIG. 11 is a perspective view of the top portion of the embodiment of the rapid feed valve member illustrated in FIG. 8.

FIG. 8 is a partial exploded assembly view another embodiment of a loader 110 having a rapid feed attachment 160 supported thereby. FIGS. 9, 10 are perspective views of the embodiment of the extension member 162 illustrated in FIG. 8. FIGS. 11, 12 are perspective views of the embodiment of the rapid feed valve member 164 illustrated in FIG. 8. As illustrated therein, in some embodiments, the rapid feed attachment 160 can be used in place of the lid member 102 described above.

In some embodiments, the rapid feed attachment 160 can comprise an extension member 162 and a rapid feed valve member 164. The extension member 162 can be configured to be received by the opening 113 formed in the carrier member 111, or received by the opening 112 formed in the upper shell member 110. In the illustrated embodiment, if the extension member 162 is configured to be received by the opening 113 formed in the carrier member 111. One or more tabs or latches 166 formed or supported by the extension member 162 can be configured to securely, but removably, attach the extension member 162 to the carrier member 111. Additionally, in some embodiments, the extension member 162 can also have tabs 168 that can be configured to be received within complementary depressions or openings formed in the carrier member 111, for example the openings formed in the carrier member configured to support the spring mechanism 124.

Additionally, the extension member 170 can have an annular channel or depression 170 that can be configured to receive the generally rigid perimeter portion 172 of the rapid feed valve member 164. In some embodiments, the rapid feed valve member 164 can be removably snapped into the channel 170 so that the rapid feed valve member 164 is generally prevented from becoming inadvertently disengaged from the extension member 162.

With reference to FIGS. 11 and 12, the rapid feed valve member 164 can have a substantially rigid perimeter portion 172 configured to support a plurality of substantially pliable or flexible flaps 174 which can be configured to generally prevent paintballs from falling out of the casing 106 during operation of the loader 100. As such, the flaps 174 can be configured to be deflectable in an inward direction (i.e., toward the opening 112 formed in the upper shell member 110) when paintballs located outside of the casing 106 are forced against the outside surface 174*a* of the flaps 174, so as to permit paintballs to be loaded into the casing 106 when a user so desires. The flaps 174 can be substantially stiff or rigid and otherwise configured to resist deflecting outwardly (i.e., away from the opening 112 formed in the upper shell member 110) when paintballs located inside the casing 106 are forced against the inside surface 174*b* of the flaps, so as to prevent paintballs located inside the casing 106 from inadvertently falling out of the casing 106.

In some embodiments, the rapid feed valve member 164 can be formed from a single material such that the flaps 174 and the perimeter portion 172 are formed as a single, integral component. In some embodiments, the rapid feed valve member 164 can be formed from two or more materials. In particular, in some embodiments, the perimeter portion 172 or a portion thereof can be formed from a rigid or semi-rigid material such as a plastic or a hard rubber. Additionally, support members 175, which can be configured to provide additional support to each of the flaps 174, can be formed from a rigid or semi-rigid material such as a plastic or a hard rubber. In this arrangement, with reference to FIG. 11, the extended portions 177 of each of the flaps 174 can be formed from a more pliable or resilient material, such as rubber or any other suitable material. In some embodiments, in this arrangement, the lower portion 172*a* of the perimeter portion 172 (as illustrated most clearly in FIG. 12) can also be formed from the same material used to form the extended portions 177. In some embodiments, each of the extended portions 177 as well as the lower portion 172*a* or other portion of the perimeter portion 172 can be integrally formed or molded with, or otherwise joined with, the support members 175 and the rigid portion of the perimeter portion 172 to form a single component.

Figure 13:
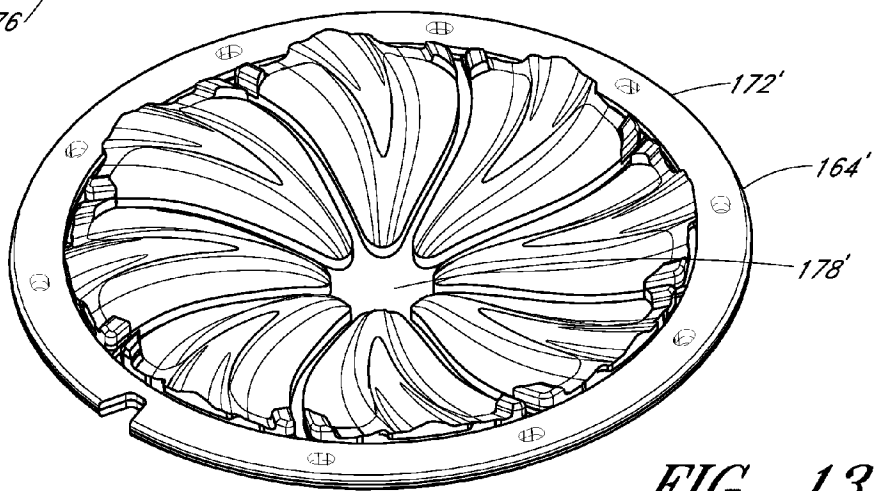
FIG. 13 is a perspective view of another embodiment of a rapid feed valve member.

Again with reference to FIGS. 11, 12, the flaps 174 of the rapid feed valve member 164 can be sized, shaped, and arranged, and otherwise configured to define a space or channel 176 and an opening 178 therebetween. In some embodiments, as in the illustrated embodiment, the rapid feed valve member 164 can be configured so that the opening 178 is located generally off-center from the center point of the perimeter portion 172 of the rapid feed valve member 164. However, in some embodiments, as in the embodiment of the rapid feed valve member 164' illustrated in FIG. 13, the rapid feed valve member 164' can be configured so that the opening 178' is located at the approximate center point of the perimeter portion 172' of the rapid feed valve member 164'.

Additionally, with reference to FIG. 9, the extension member 162 can have a rim portion 180 that can be configured to direct paintballs into the opening 182 formed in the extension member 162. In particular, the rim portion 180 can have an inwardly sloped surface 180*a* that is configured to bias the paintballs to fall into the opening 182 formed in the extension member 162 or to direct paintballs toward the opening 182.

Figure 14:
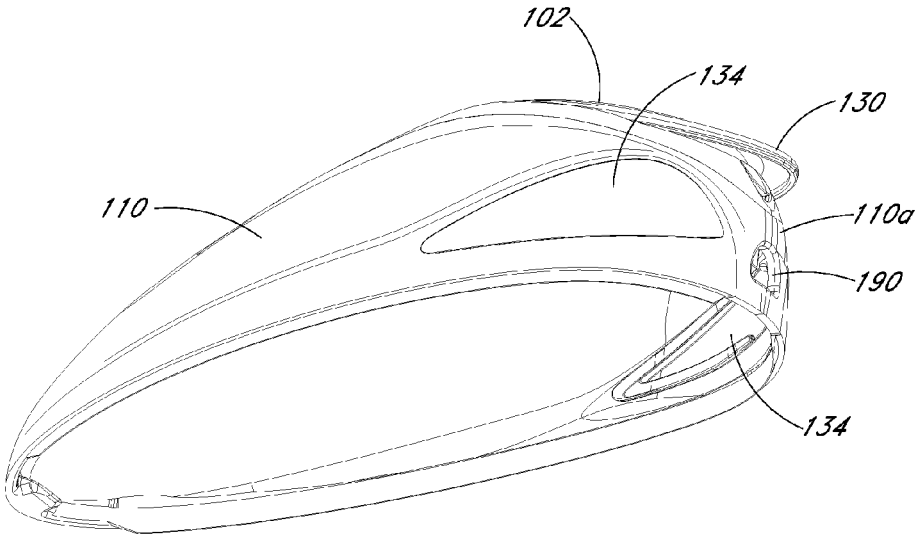
FIG. 14 is a perspective view of the embodiment of the upper shell member shown in FIG. 1.
Figure 15:
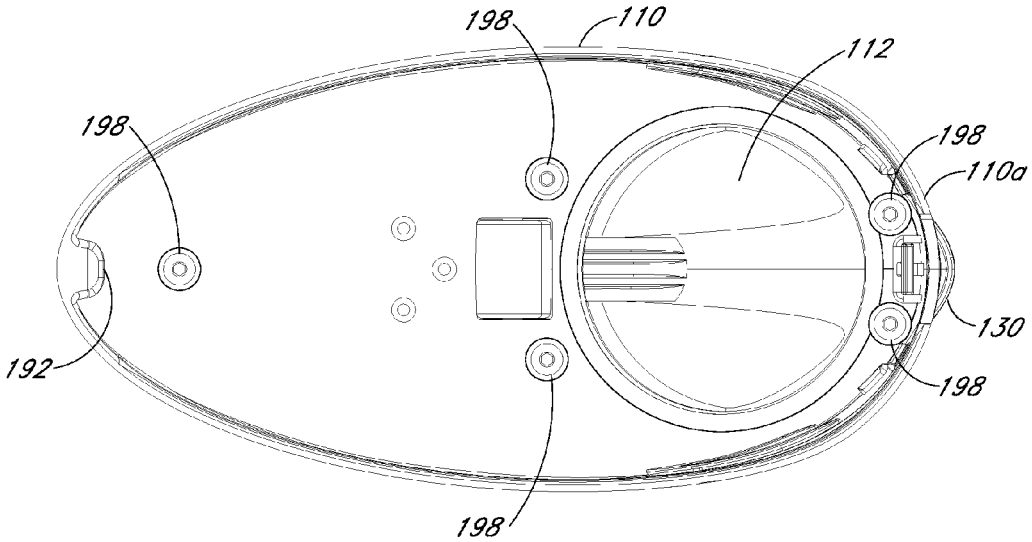
FIG. 15 is a bottom view of the embodiment of the upper shell member shown in FIG. 1, showing the inside of the upper shell member 110.
Figure 16B:
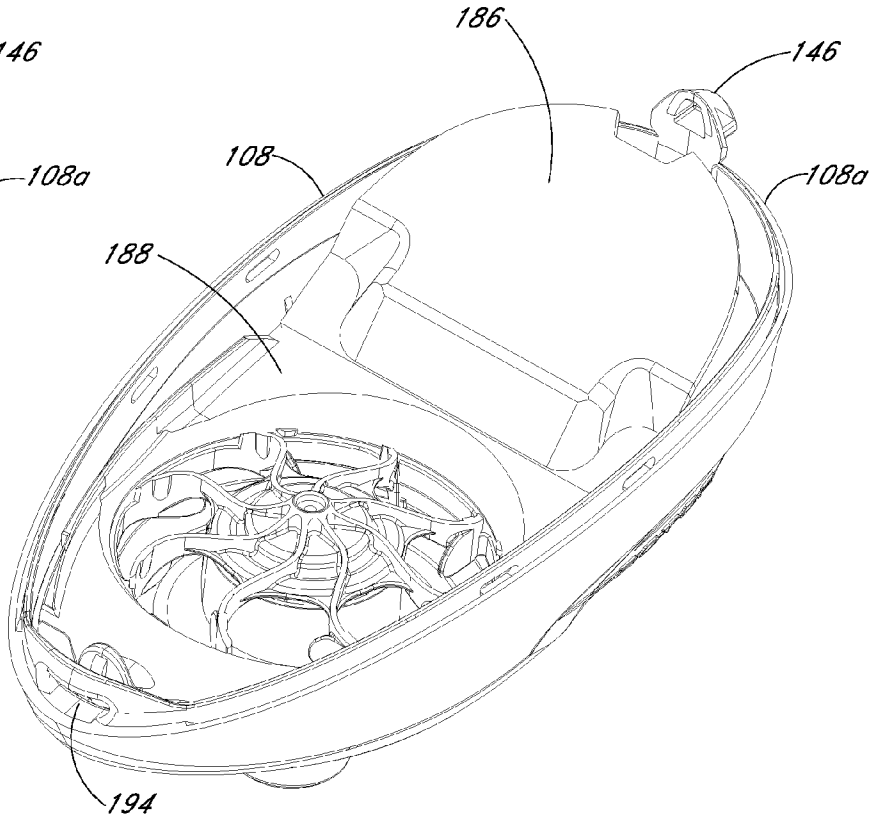
FIG. 16B is a perspective view of the embodiment of the loader shown in FIG. 1, after the upper shell member has been disengaged from the lower shell member, showing the flap member in a second position relative to the base cover member.
Figure 16A:
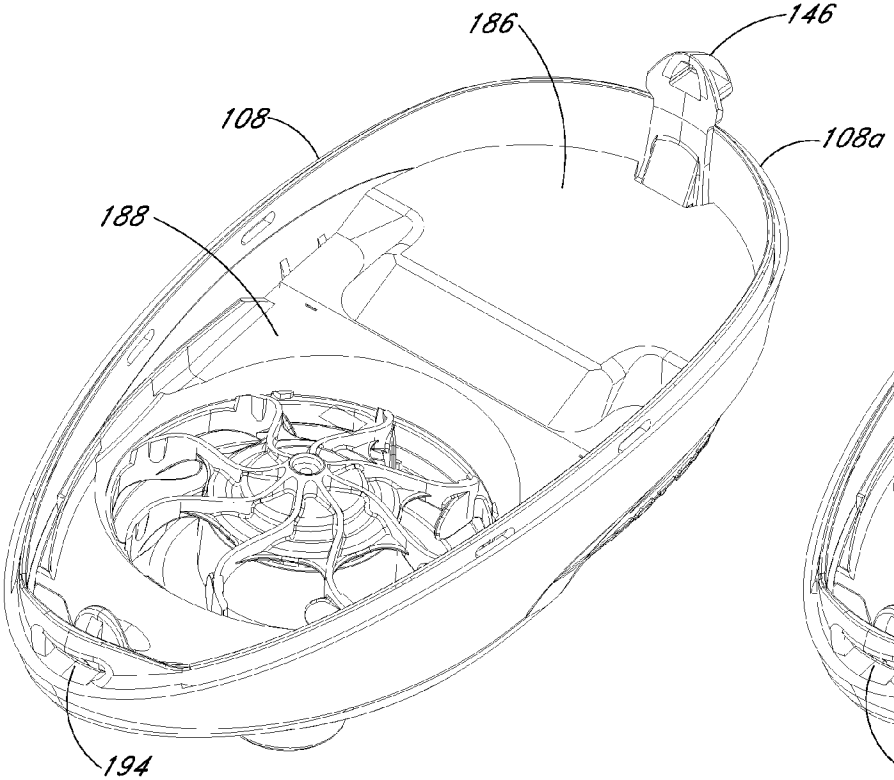
FIG. 16A is a perspective view of the embodiment of the loader shown in FIG. 1, after the upper shell member has been disengaged from the lower shell member, showing the flap member in a first position relative to the base cover member.

FIG. 14 is a perspective view of the embodiment of the upper shell member 110 shown in FIG. 1. FIG. 15 is a bottom view of the embodiment of the upper shell member 110 shown in FIG. 1, showing the inside of the upper shell member 110. FIGS. 16A and 16B are perspective views of the embodiment of the loader shown in FIG. 1, after the upper shell member 110 has been disassembled from the lower shell member 108, showing a ramp member 186 in a first position and a second position, respectively, relative to the base cover member 188.

In some embodiments, when the ramp member 186 is in a second or raised position (as illustrated in FIG. 16B), the ramp member 186 can facilitate channeling paintballs into the rotor assembly which, as will be described in greater detail below, feeds balls through the opening 116 in the boss 114 so as to deliver paintballs to the marker that supports the loader 100. Thus, in the second position, the paintballs can be funneled toward the rotor assembly without the user having to tilt, shake, or otherwise change the orientation of the loader 100 in order for substantially all of the paintballs to feed into the rotor assembly.

In some embodiments, the ramp member 186 can be configured to rotate to the first position (as illustrated in FIG. 16A), so as to increase the volume and paintball capacity of the loader 100 when a large number of paintballs are loaded into the casing 106 of the loader 100. In some embodiments, the loader 100 can be assembled without the ramp member 186. In some embodiments, the base cover member 188 can be configured to cover the batteries, rotor drive components, and other components supported within the lower shell member 108, so as to generally seal off the batteries, rotor drive components, and other components supported within the lower shell member 108 so as to limit the exposure of these components to paintballs or liquid from a ruptured paintball as the paintballs are being fed through the loader 100.

As will become apparent, in some embodiments, the loader 100 can be configured such that most if not all of the components comprising the loader 100 can be disassembled without the use of any tools, so that a user can quickly and easily disassemble most or all of the components, as desired, for quick cleaning and/or maintenance. With reference to FIGS. 14-16B, as mentioned above, the upper shell member 110 can be disengaged from the lower shell member 108 by depressing the latch member 146 so as to displace the latch member 146 through the opening 190 formed in the upper shell member 110 a sufficient distance to disengage the latch member 146 from the upper shell member 110, and then by lifting the front portion 110*a* of the upper shell member 110 away from the front portion 108*a* of the lower shell member 108. In some embodiments, the upper shell member 110 can have a tab 192 that can be configured to be slidably received by the opening 194 formed in the lower shell member 108, so that such tab 192 should be disengaged from the opening 194 to completely disassemble the upper shell member 110 from the lower shell member 108. Additionally, as most clearly seen in FIG. 15, the upper shell member 110 can have a plurality of bosses having openings axially positioned therein configured to receive the fasteners 115 discussed above. As discussed above, the fasteners 115 can be used to secure the carrier member 111 to the upper shell member 110.

Figure 17:
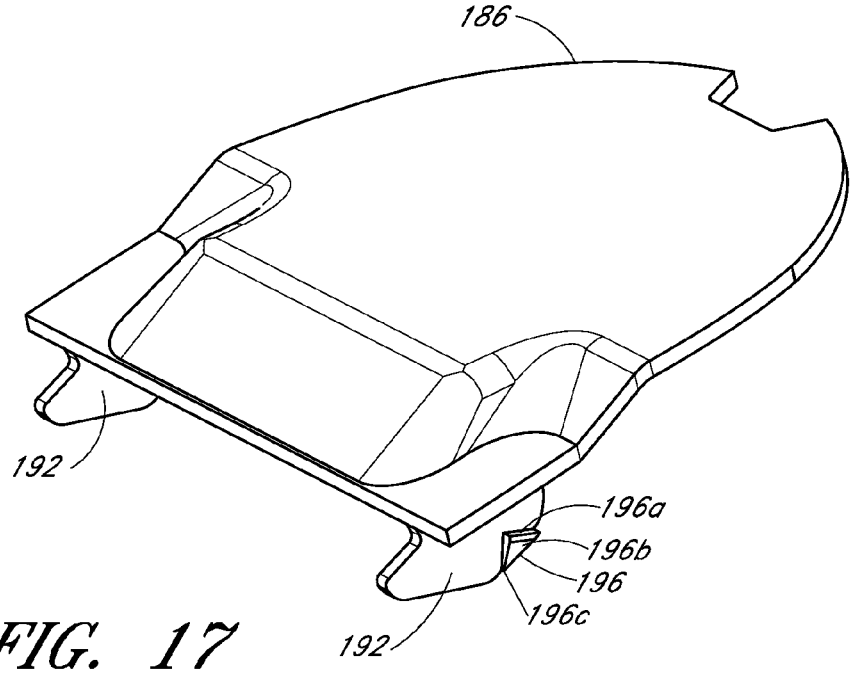
FIG. 17 is a perspective view of the top portion of an embodiment of a ramp member of the embodiment of the loader shown in FIG. 1.
Figure 18:
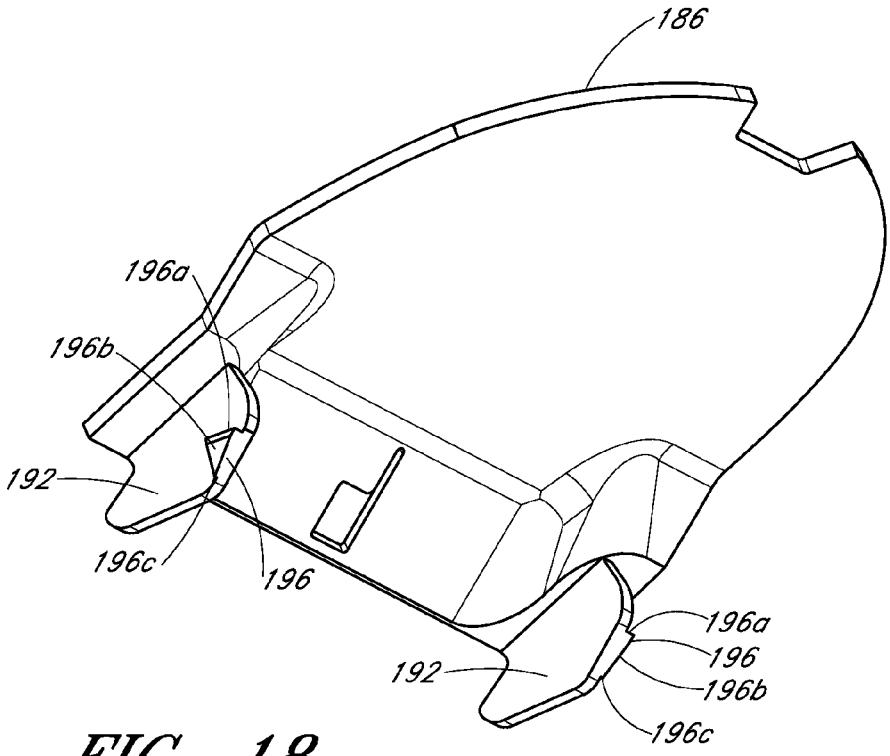
FIG. 18 is a perspective view of the bottom portion of the embodiment of a ramp member shown in FIG. 17.
Figure 19:
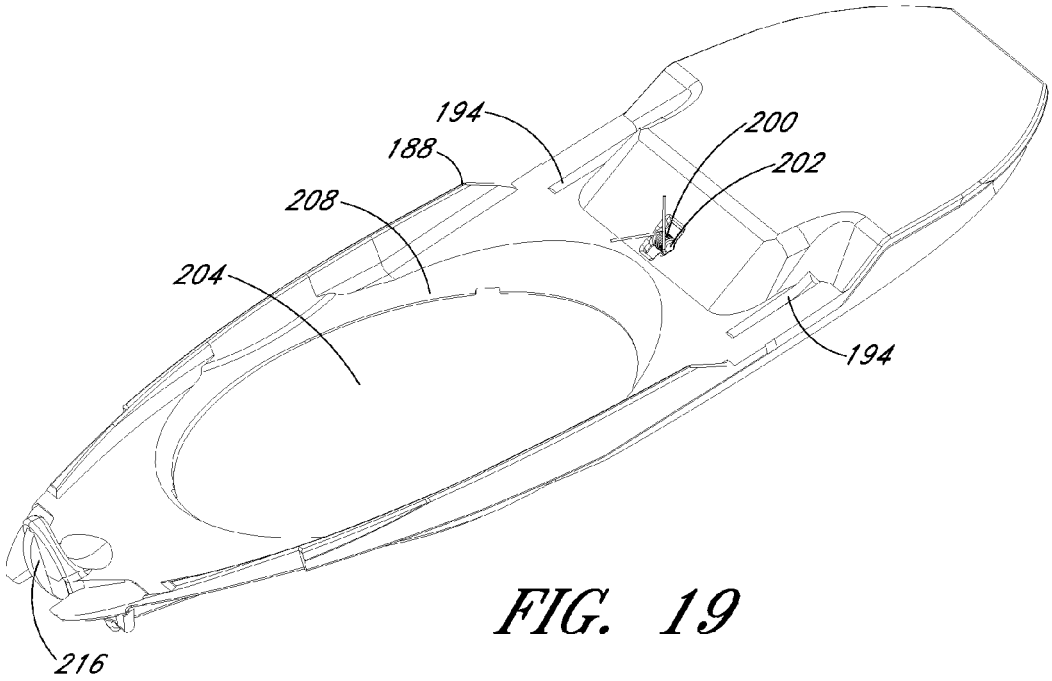
FIG. 19 is a perspective view of the top portion of an embodiment of a base cover member of the embodiment of the loader shown in FIG. 1.
Figure 20:
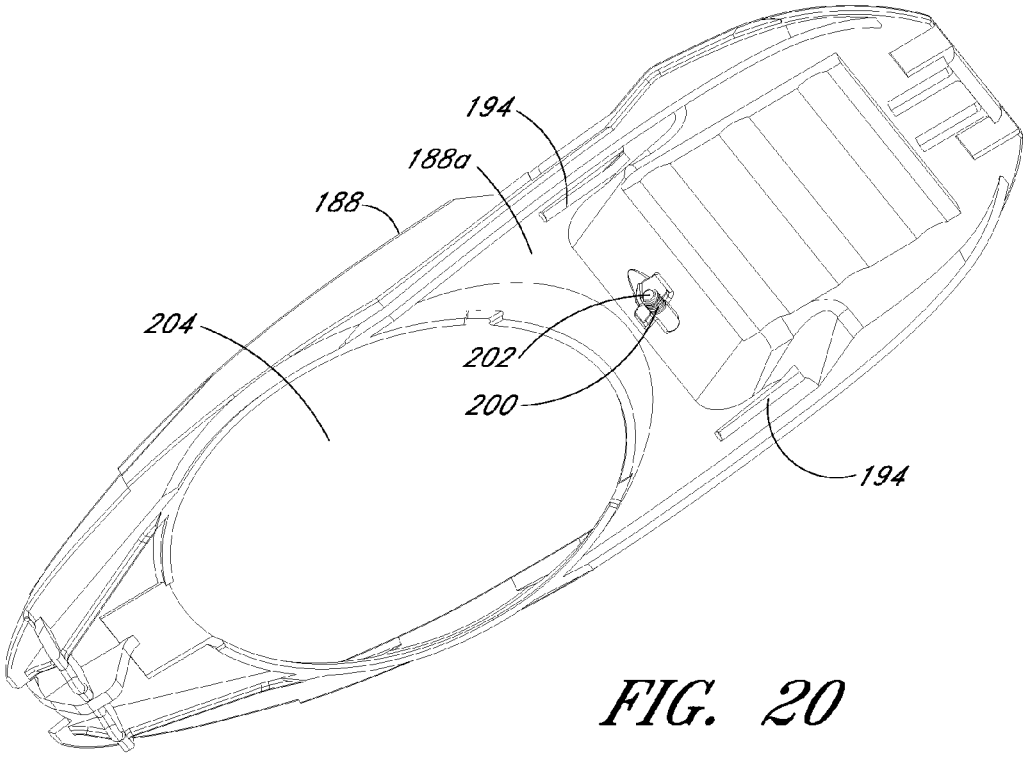
FIG. 20 is a perspective view of the bottom portion of the embodiment of a base cover member shown in FIG. 19.

FIGS. 17, 18 are perspective views of an embodiment of a ramp member 186 of the embodiment of the loader shown in FIG. 1. FIGS. 19, 20 are perspective views of an embodiment of a base cover member 188 of the embodiment of the loader 100 shown in FIG. 1. With reference to FIGS. 6 and 16A-20, as mentioned briefly above, in some embodiments, the loader 100 can have a ramp member 186 rotatably supported by the base cover member 188. In particular, some embodiments of the loader 100 can be configured so that the tabs 192 that can be integrally formed on the ramp member 186 are received within the openings 194 formed in the base cover member 188. In this arrangement, the ramp member 186 can rotate between the first or flattened position, as illustrated in FIG. 16A, and the second or raised position, as illustrated in FIG. 16B.

Some embodiments of the ramp member 186 can be configured to limit the range of rotational motion of the ramp member 186 relative to the base cover member 188 so as to limit the position of the ramp member 186 relative to the base cover member 188 when the ramp member 186 is in the fully raised or second position. In particular, in some embodiments, one or more stops or protrusions 196 can be formed on the opposing outside surfaces of each of the tabs 192 that can be configured to limit the rotational motion of the ramp member 186 relative to the base cover member 188. The protrusions 196 can be sized and positioned on the tabs 192 so that, as the ramp member 186 is rotated to the second position relative to the base cover member 188, the top surface 196*a* of the protrusions 196 abuts with the bottom surface 188*a* of the base cover member 188 adjacent to each of the openings 194 to inhibit the further rotation of the ramp member 186 relative to the base cover member 188.

In some embodiments, as in the illustrated embodiment, each protrusion 196 can have a sloped or slanted surface 196*b* sized and configured such that a lower portion 196*c* of each protrusion 196 has a smaller thickness than a portion of each protrusion adjacent to the top surface 196*a* of each protrusion 196. The sloped surface 196*b* can facilitate the assembly of the ramp member 186 with the base cover member 188 by making it easier to insert the tabs 192 into the channels 194.

In some embodiments, the cumulative thickness of each protrusion 196 (at its largest thickness position) of each tab 192 can be approximately equal to the width of each channel 194 so that each tab 192 of the ramp member 186 can be easily inserted into each channel 194 when the ramp member 186 is assembled with the base cover member 194. In some embodiments, the cumulative thickness of each protrusion 196 (at its largest thickness position) and each tab 192 can be slightly greater than the width of each channel 194 so that each tab 192 of the ramp member 186 must be forced or snapped into each channel 194 when the ramp member 186 is assembled with the base cover member 194, so as to ensure that the top surface 196*a* of each protrusion 196 can overlap and abut the bottom surface 188*a* of the base cover member 188.

In some embodiments, the tabs 192 can be positioned on the ramp member 186 so that the width or distance between the tabs 192 is slightly greater than the width or distance between each of the channels 194 so that the tabs 192 must deflect slightly inward when the ramp member 186 is assembled with the base cover member 188. After the ramp member 186 has been assembled with the base cover member 188, the tabs 192 can deflect slightly outward so as to ensure that the protrusion 196 formed on each tab 192 can overlap and abut the bottom surface 188*a* of the base cover member 188 and prevent the over-rotation of the ramp member 186 relative to the base cover member 188 when the ramp member 186 is moved to the second position. In some embodiments, the tabs 192 can be angled slightly in an outward direction (i.e., in the direction of the protrusions 196) to ensure that the tabs 192 deflect outwardly after the ramp member 186 has been assembled with the base cover member 188 so that the top surface 196*a* of each tab 196 can overlap and abut the bottom surface 188*a* of the base cover member 188.

With reference to FIGS. 6, 19, and 20, the base cover member 188 can be configured to support and a spring member 200 that can be configured to bias the ramp member 186 in the second position relative to the base cover member 188. In particular, a generally cylindrical protrusion 202 can be integrally formed with, or otherwise supported by, the base cover member 188. The protrusion 202 can be configured to support the spring member 200 in such a manner that the spring member 200 can exert the above-mentioned biasing force on the ramp member 186.

Figure 21:
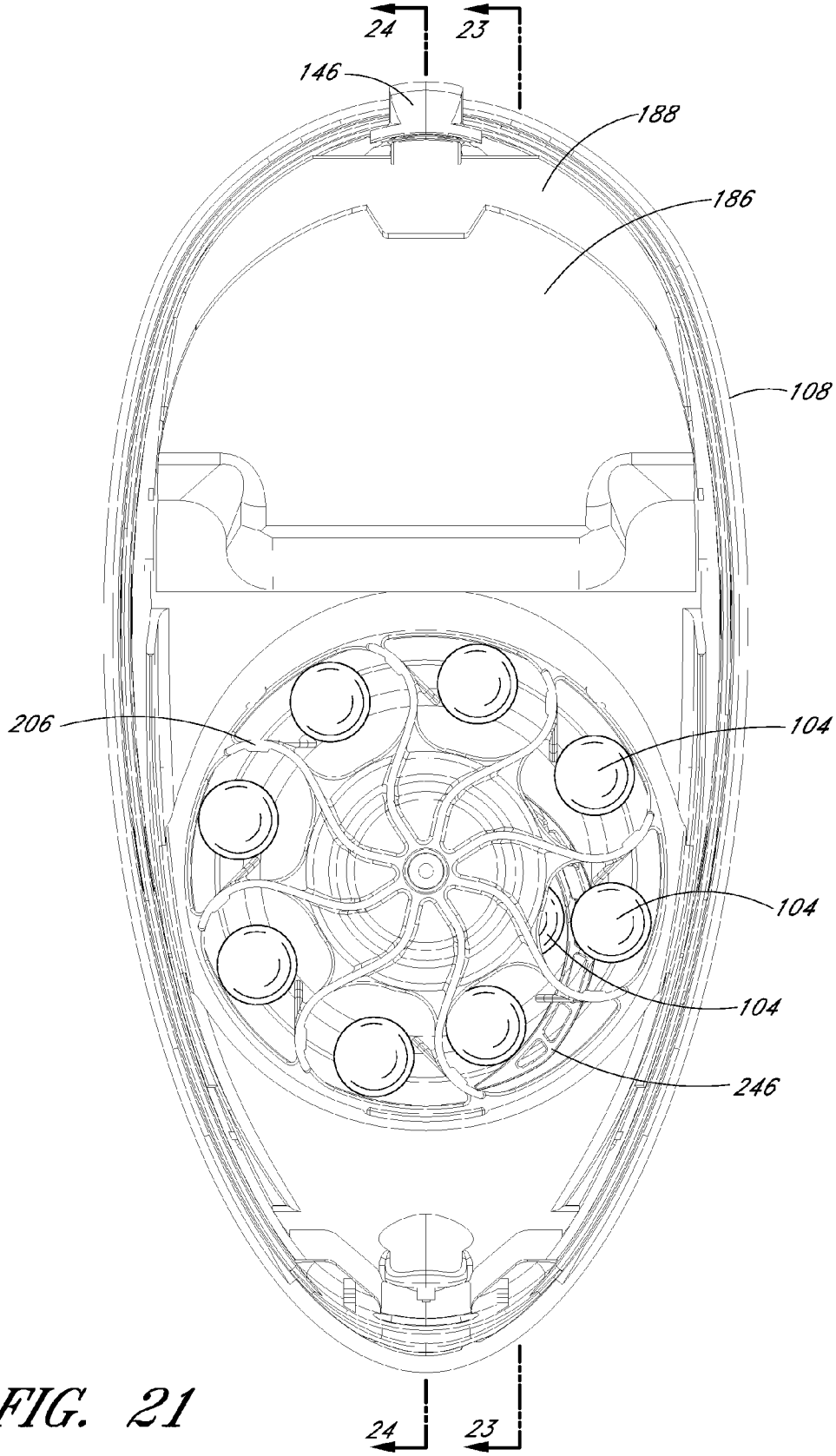
FIG. 21 is a top view of the embodiment of the loader shown in FIG. 1, after the upper shell member has been disengaged from the lower shell member, showing the ramp member in the second position and the base cover member in the first position relative to the lower case member, and showing a plurality of paintballs within the loader.
Figure 22A:
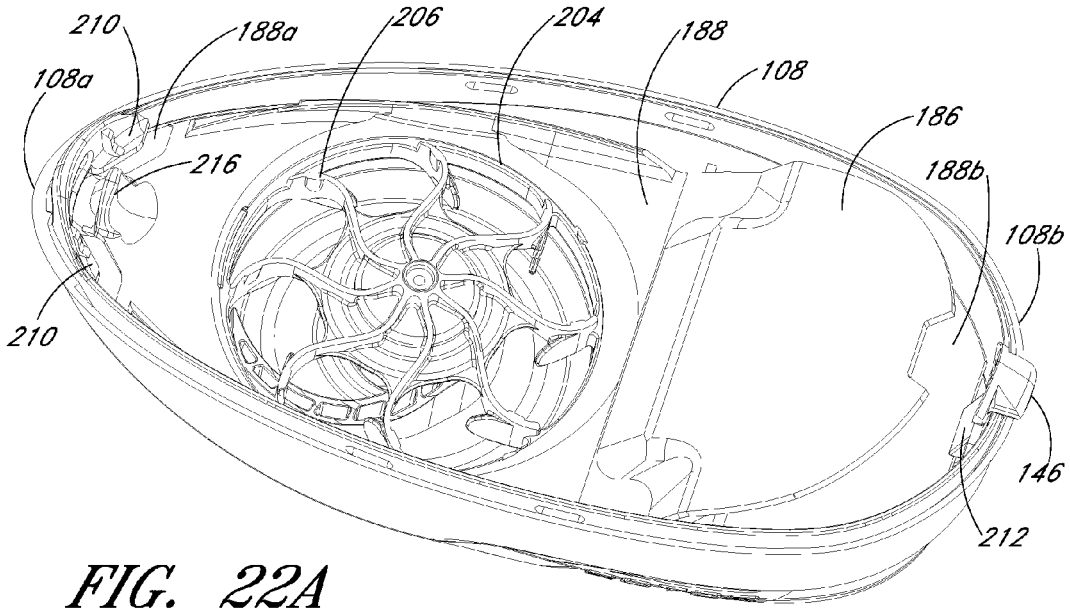
FIG. 22A is a perspective view of the embodiment of the loader shown in FIG. 1, after the upper shell member has been disassembled from the lower shell member, showing the ramp member in the second position and the base cover member in a first position relative to the lower case member.
Figure 22B:
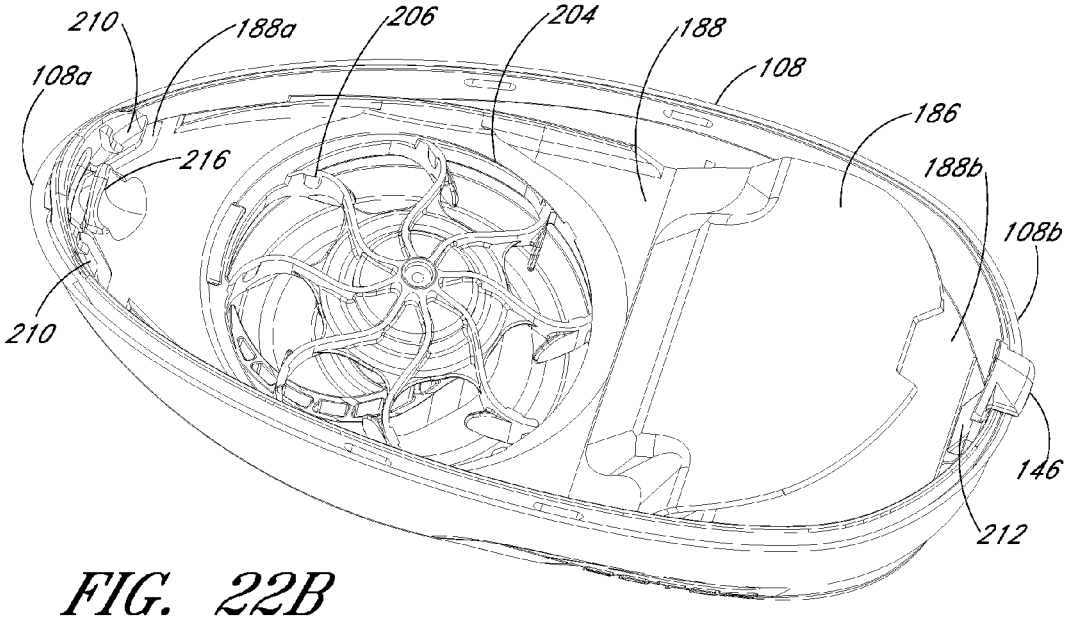
FIG. 22B is a perspective view of the embodiment of the loader shown in FIG. 1, after the upper shell member has been disassembled from the lower shell member, showing the ramp member in the second position and the base cover member in a second position relative to the lower case member.
Figure 23:
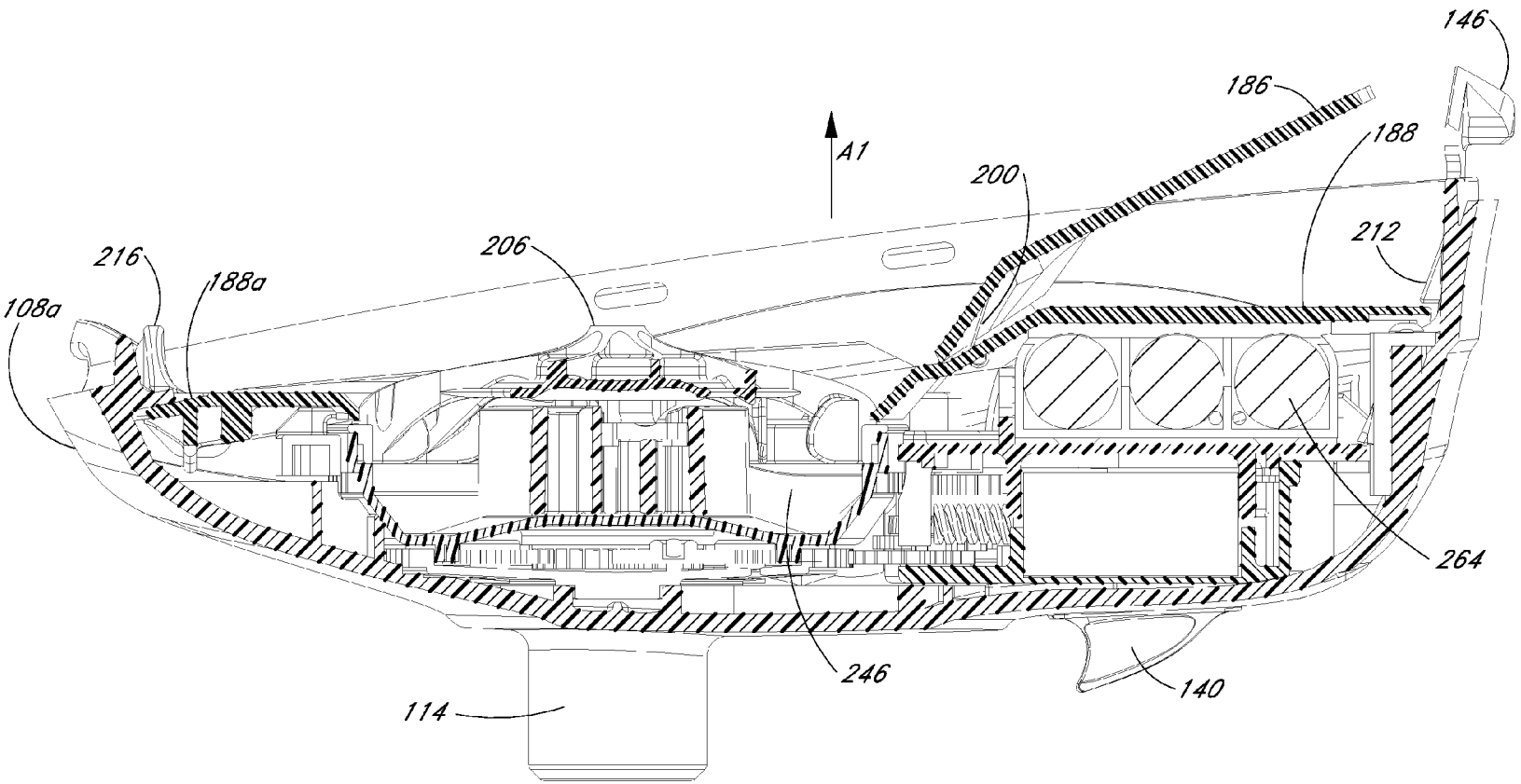
FIG. 23 is a section view of the loader shown in FIG. 1, after the upper shell member has been disassembled from the lower shell member, showing the ramp member in the second position and the base cover member in the first position relative to the lower case member, taken through the line 23-23 shown in FIG. 21.
Figure 24:
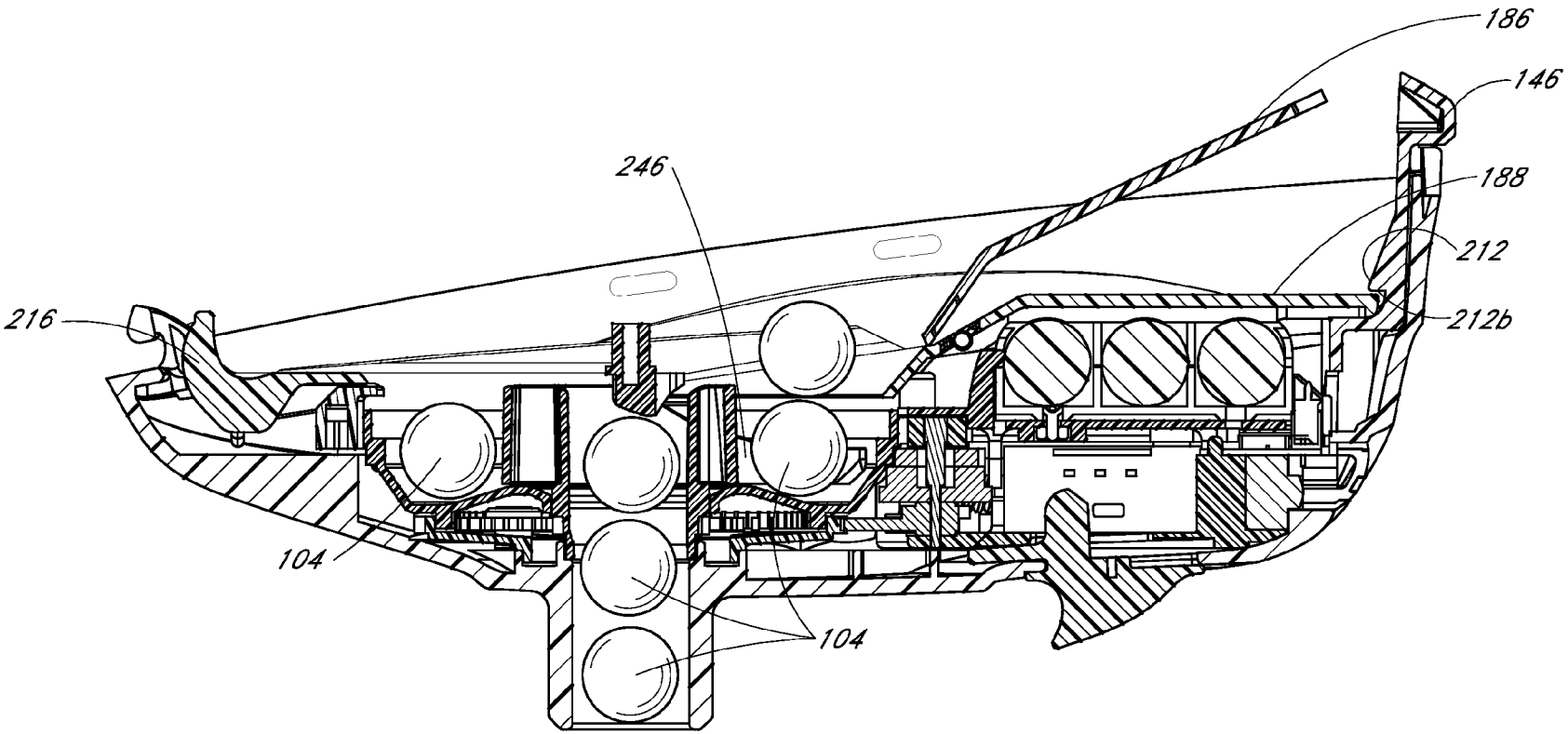
FIG. 24 is a section view of the loader shown in FIG. 1, after the upper shell member has been disassembled from the lower shell member, showing the ramp member in the second position and the base cover member in the first position relative to the lower case member, taken through the line 24-24 shown in FIG. 21.

FIG. 21 is a top view of the embodiment of the loader 100 shown in FIG. 1, after the upper shell member 110 has been disassembled from the lower shell member 108, showing the ramp member 186 in the second position and the base cover member 188 in the first position relative to the lower case member 108, and showing a plurality of paintballs within the loader. FIGS. 22A and 22B are perspective views of the embodiment of the loader 100 shown in FIG. 1, after the upper shell member 110 has been disassembled from the lower shell member 108, showing the ramp member 186 in the second position, and the base cover member 188 in a first position and a second position, respectively, relative to the lower case member 108. FIGS. 23 and 24 are section views of the embodiment of the loader 100 shown in FIG. 1, after the upper shell member 110 has been disassembled from the lower shell member 108, showing the ramp member 186 in the second position and the base cover member 188 in the first position relative to the lower case member 108, taken through the line 23-23 and the line 24-24, respectively, shown in FIG. 21. Some paintballs are shown in FIG. 24, while no paintballs are shown in FIGS. 22A-22B. Although it is not anticipated that the loader 100 would be operated with the upper shell member 110 disassembled from the lower shell member 108, the upper shell member 110 has been removed from these drawings for illustration purposes.

As illustrated therein, the base cover member 188 can have an opening 204 formed therein that can be sized and shaped to be approximately equal to, or slightly greater than, the perimeter of a rotor member 206 that can be supported within the lower casing 108 as described below. Additionally, in some embodiments, the base cover member 188 can have a downwardly sloping surface 208 surrounding the opening 204, configured to help funnel or channel paintballs toward the opening 204 formed in the base cover member 188.

As will be described, in some embodiments, the base cover member 188 can be removed from the lower shell member 108 without the use of any tools so as to permit a user to access the components of the loader 100 supported by the lower shell member 108 beneath the cover member 188. With reference to FIGS. 21-22B, the front portion 188*a* of the base cover member 188 can be held in place by one or more tabs 210 (two being shown) formed integrally with or otherwise supported by the lower shell member 108 and located at the front portion 108*a* of the lower shell member 108. In particular, as illustrated most clearly in FIG. 23, each of the one or more tabs 210 can overlap and abut the front portion 188*a* of the base cover member 188 so as to releasably secure the front portion 188*a* of the base cover member 188 and, hence, prevent the front portion 188*a* of the base cover member 188 from translating in the direction represented by the arrow A1 shown in FIG. 23.

Figure 26:
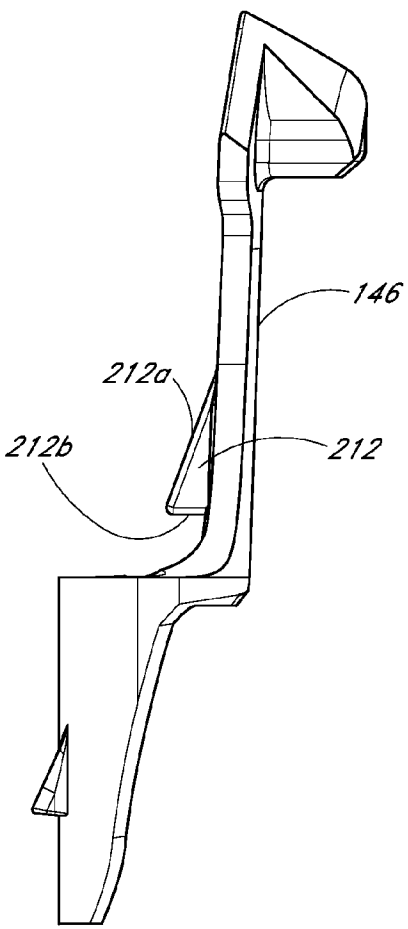
FIG. 26 is a side view of the embodiment of the latch member illustrated in FIG. 25.
Figure 25:
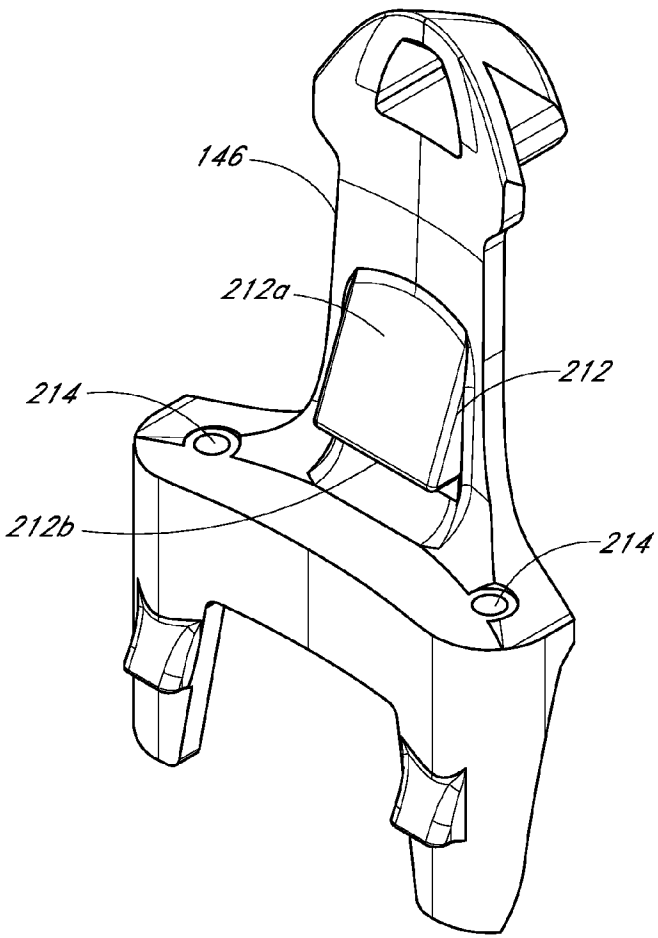
FIG. 25 is a perspective view of an embodiment of a latch member of the embodiment of the loader illustrated in FIG. 1.

FIGS. 25 and 26 are a perspective view and a side view, respectively, of an embodiment of a latch member 146 of the embodiment of the loader 100 illustrated in FIG. 1. With reference to FIGS. 24-26, the rear portion 188*b* of the base cover member 188 can be releasably secured by the latch member 146 so as to prevent the rear portion 188*b* of the base cover member 188 from translating in the direction represented by the arrow A1 discussed above. In particular, the latch member 146 can have a protrusion 212 formed integrally with or otherwise supported by the latch member 146 that can be configured to releasably secure the rear portion 188*b* of the base cover member 188 relative to the lower shell member 108. With reference to FIGS. 25-26, the protrusion 212 can be configured to have a slanted surface 212*a* and a lower surface 212*b*. The lower surface 212*b* can be configured to overlap and, hence, secure the base cover member 188 so as to prevent the rear portion 188*b* of the base cover member 188 from translating in the A1 direction when the base member 188 is in the first or rearmost direction relative to the lower shell member 108. In some embodiments, the base cover member 188 can be biased toward the first or rearmost direction. One or more openings 214 can be formed in the latch member 146, configured to receive one or more fasteners 215 that can be threadably inserted into the threaded bosses 217 formed in the lower shell member 108.

In this configuration, when the base cover member 188 is moved from the first position (as illustrated in FIG. 22A) to the second position (as illustrated in FIG. 22B) such that the second surface 212*b* of the latch member 146 no longer overlaps and, hence no longer secures, the rear portion 188*b* of the base cover member 188, the rear portion 188*b* of the base cover member 188 can then be removed by a user by translating the rear portion 188*b* of the base cover member 188 in the A1 direction. In some embodiments, a tabbed protrusion 216 can be formed integrally with or otherwise supported by the base cover member 188 and configured to assist a user in translating the base cover member 188 from the first position (as illustrated in FIG. 22A) to the second position (as illustrated in FIG. 22B), or vice versa. After the rear portion 188*b* of the base cover member 188 has been translated away from the lower shell member 108 in the A1 direction, the front portion 188*a* of the base cover member 188 can be removed from the lower shell member 108 by translating the base cover member away from the front portion 108*a* of the lower shell member 108 (i.e., toward the rear portion 108*b* of the lower shell member 108) such that the one or more tabs 210 no longer overlap the front portion 188*a* of the base cover member 188.

Figure 27:
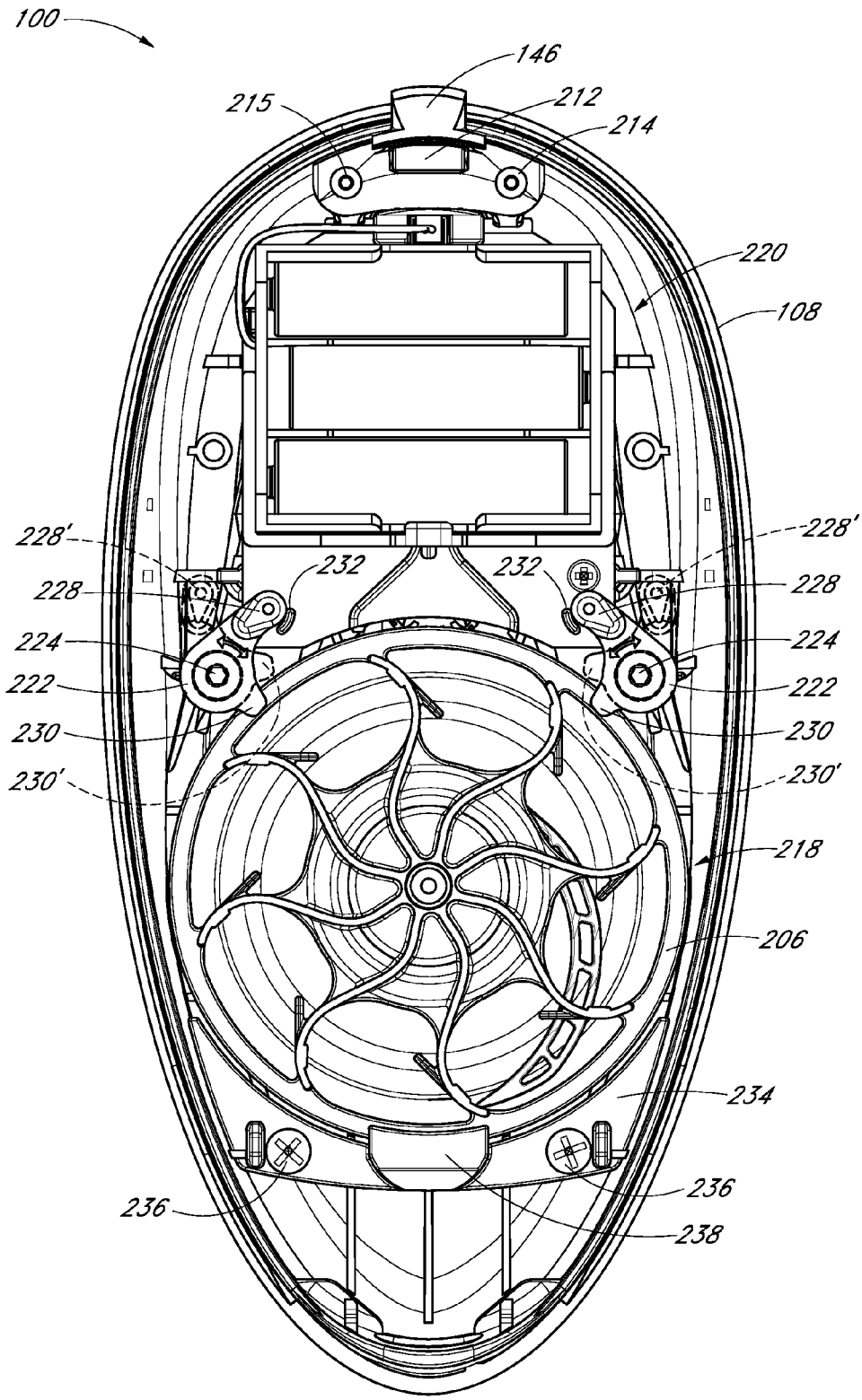
FIG. 27 is a top view of the embodiment of the loader shown in FIG. 1, after the upper shell member and base cover member have been disassembled from the lower shell member.
Figure 28:
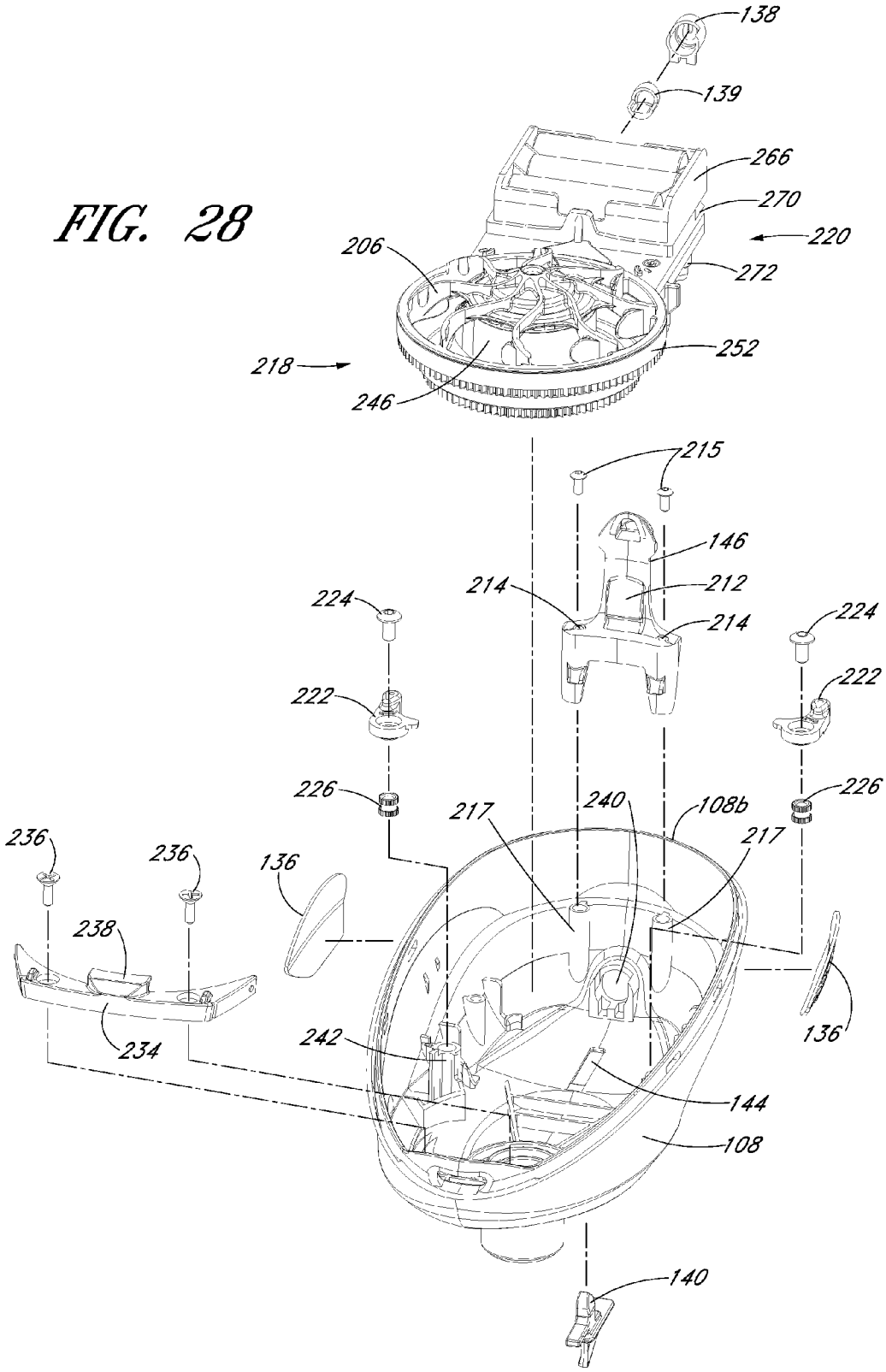
FIG. 28 is an exploded assembly view of the components of the embodiment of the loader shown in FIG. 27.

FIG. 27 is a top view of the embodiment of the loader 100 shown in FIG. 1, after the upper shell member 110 and base cover member 188 have been disassembled from the lower shell member 108. FIG. 28 is an exploded assembly view of the components of the embodiment of the loader 100 shown in FIG. 27. With reference to FIGS. 27 and 28, the lower shell member 108 of the loader 100 can be configured to support a paintball feeder assembly 218 and a drive motor assembly 220 that can each be removed from the lower shell member 108 without the use of any tools.

For example, in some embodiments, as in the embodiment illustrated in FIG. 27, the feeder assembly 218 and the drive motor assembly 220 can be supported by the lower shell member 108 and selectively secured in the lower shell member 108 so as to avoid inadvertent disengagement of the feeder assembly 218 and the drive motor assembly 220 from the lower shell member 108 with the use of one or more rotatably supported retention tabs 222. As illustrated in FIG. 27, each of the retention tabs 222 can be configured to rotate between a first or secured position (illustrated in solid lines in FIG. 27) and a second or free position (illustrated in dashed lines in FIG. 27). In the first position, the retention tabs 222 can be positioned so as to overlap a portion of the rotor member 206 (a component of the feeder assembly 218) and at least a portion of the drive motor assembly 220 so that the rotor member 206 and the drive motor assembly 220 are prevented from inadvertently becoming disengaged from or translating away from the lower shell member 108.

In particular, with reference to FIGS. 27 and 28, each of the retention tabs 222 can be removably attached to the lower shell member 108 using a fastener 224 and bushing 226, although any suitable fastening methods or components can be used. Each of the retention tabs 222 can be configured to have an end portion 228 configured to overlap at least a portion of the drive motor assembly 220 in the first position and also having a raised protrusion projecting from the end portion 228 configured to facilitate a user's ability to rotate the retention tabs 222. Additionally, some embodiments of the tabs 222 can have an extended portion 230 configured to overlap the rotor member 206 in the first or secured position.

In the second position of each retainer tab 222, illustrated in dashed lines in FIG. 27, the end portion 228' (for this component, the callout 228' designates the end portion of each retainer tab 222 in the second position) and the extended portion 230' (similarly, the callout 230' designates the extension portion of each retainer tab 222 in the second position) can be rotated about the fastener 224 and bushing 226 away from the rotor member 206 so that the extended portion 230' no longer overlaps the rotor member 206 and so that the end portion 228 of each tab no longer overlaps the drive motor assembly 220. In this configuration, when the retention tabs 222 are in the second position, a user can easily remove the rotor member 206 and/or the drive motor assembly 220 by lifting the rotor member 206 and/or the drive motor assembly 220 away from the lower shell member 108. In some embodiments, when the retention tabs 222 are in the second position, a user can remove the rotor member 206 (and then the other components of the feeder assembly 218, which will be described in greater detail below) without removing the drive motor assembly 220 and without the use of any tools. Similarly, in some embodiments, when the retention tabs 222 are in the second position, a user can remove the drive motor assembly 220 without removing the rotor member 206 (or the other components of the feeder assembly 218).

As will be discussed in greater detail below, after the rotor member 206 has been removed by a user, the remaining components of the feeder assembly 218 can then be removed without the use of tools. In some embodiments, some or all of the other components comprising the feeder assembly 218 can be removed simultaneously with the removal of the rotor member 206. In some embodiments, when the retention tabs 222 are in the second position and the feeder assembly 218 has been removed, it may then be easier to remove or replace (i.e., reassemble) the drive motor assembly 220. Any of the components comprising the feeder assembly 218 and/for the drive motor assembly 220 can be reinstalled or reassembled in the same fashion as described above regarding the removal of these components.

In some embodiments, protrusions 232 can be formed on a portion of the drive motor assembly 220. The protrusions 232 can be configured to limit the range of rotation of the retention tabs 222 such that, when the retention tabs 222 are rotated so that the end portion 228 of each tab abuts against the protrusions 232, each of the tabs 222 is then aligned in an optimal secured or first position relative to the feeder assembly 218 and the drive motor assembly 220.

In some embodiments, the retention tabs 222 are spring loaded so that a biasing force is exerted on the retention tabs 222 in the axially downward direction (i.e. with reference to FIG. 27, the axially downward direction is into the page). This arrangement can result in at least the extension portion 230 of one or more of the tabs 222 exerting a downward force on the rotor member 206. In some embodiments, this can be achieved by positioning a rubber annular ring, an elastomeric spring, a metallic spring, or any other suitable component between each fastener 224 and each retention tab 222.

In some embodiments, the retention tabs 222 and other associated components can be configured to define one or more beveled surfaces configured such that at least the extension portions 230 of each tab 222 move in the downward direction as each tab 222 is moved from the second or free position to the first or secured position. This arrangement may make it easier to move each tab 222 from the second position to the first or secured position because each tab 222 can move in a downward direction as it is being rotated to the first position, so that the extension portion 230 does not abut into or interfere with an edge of the rotor member 206 as the retention tabs 222 are being rotated to the first position. In some embodiments, a rubber annular ring, an elastomeric spring, a metallic spring, or any other suitable component can be positioned between each fastener 224 and each retention tab 222 to bias the retention tabs 222 so that the beveled surfaces remain in contact. In this configuration, the beveled arrangement can also result in a biasing force that biases each of the tab members 222 towards the first, secured position.

In some embodiments, the magnitude of the downward force imparted by each of the tabs 222 can be slight. This configuration can result in at least a slight downward force to be exerted on the rotor member 206 and/or at least some of the other components comprising the feeder assembly 218, which will be described in greater detail below. In this configuration, the tabs 222 can help prevent at least some of the components of the feeder assembly 218 from separating from one another during operation of the loader 100, potentially allowing the manufacturing tolerances of the components comprising the feeder assembly 218 to be increased or otherwise be less stringent. In some embodiments, only one of the tabs 222 can be configured to be spring loaded or otherwise configured as described above. In some embodiments, more than one of the tabs 222 can be configured to be spring loaded or otherwise configured as described above.

Some embodiments of the loader 100 can also have a retention member 234 removably attached to the lower shell member 108 using one or more fasteners 236 threadably received by one or more bosses 237 (shown in FIG. 38) formed in the lower shell member 108. The retention member 234 can be configured to have an extended portion 238 that is configured to overlap and, hence, retain the rotor assembly 218 in a similar manner as with the retention tabs 222 described above when such retention tabs 222 are in the first position. In this configuration, when the retention tabs 222 is in the second position (where the retention tabs 222 no longer overlap the rotor member 206), the loader 100 can be configured such that a user can remove the rotor member 206 from the lower shell member 108 without having to remove the retention member 234 from the lower shell member 108. In particular, in some embodiments, when the retention tabs 222 are in the second position, a user can remove the rotor member by first lifting the end of the rotor member 206 that is closest to the drive motor assembly 220 away from the lower shell member 108, and then translating the rotor member 206 simultaneously away from the lower shell member 108 and the retention member 234.

Additionally, as illustrated in FIG. 28, the power switch 138 can be slidably supported by the lower shell member 108 so that at least a portion of the power switch 138 can pass through the opening 240 formed in the lower shell member 108. In some embodiments, an insert 139 can be assembled with the power switch 138 (i.e., inserted into the opening formed in the power switch 138) to provide greater contact surface for the power switch relative to a contact button (not illustrated) supported on a control or circuit board. Additionally, a pair of bosses 242 having axial openings therein can be configured to receive the fasteners 224 and/or bushings 226 described above. Additionally, as mentioned above, the trigger member 140 can be positioned within the channel 144 and supported by the lower shell member 108 by snapping the trigger member 140 into the channel 144. As such, in some embodiments, the trigger member 140 can have a pair of flanged tabs that, once inserted into the channel 144, spread apart and have overlapping surfaces so that the lower shell member 108 retains the trigger member 140. As mentioned above, the loader 100 can be configured so that the trigger member 140 is able to translate fore and aft (i.e. toward and away from the rear portion 108*b* of the lower shell member 108) relative to the channel 144 and, hence, relative to the drive motor assembly 220.

Figure 29:
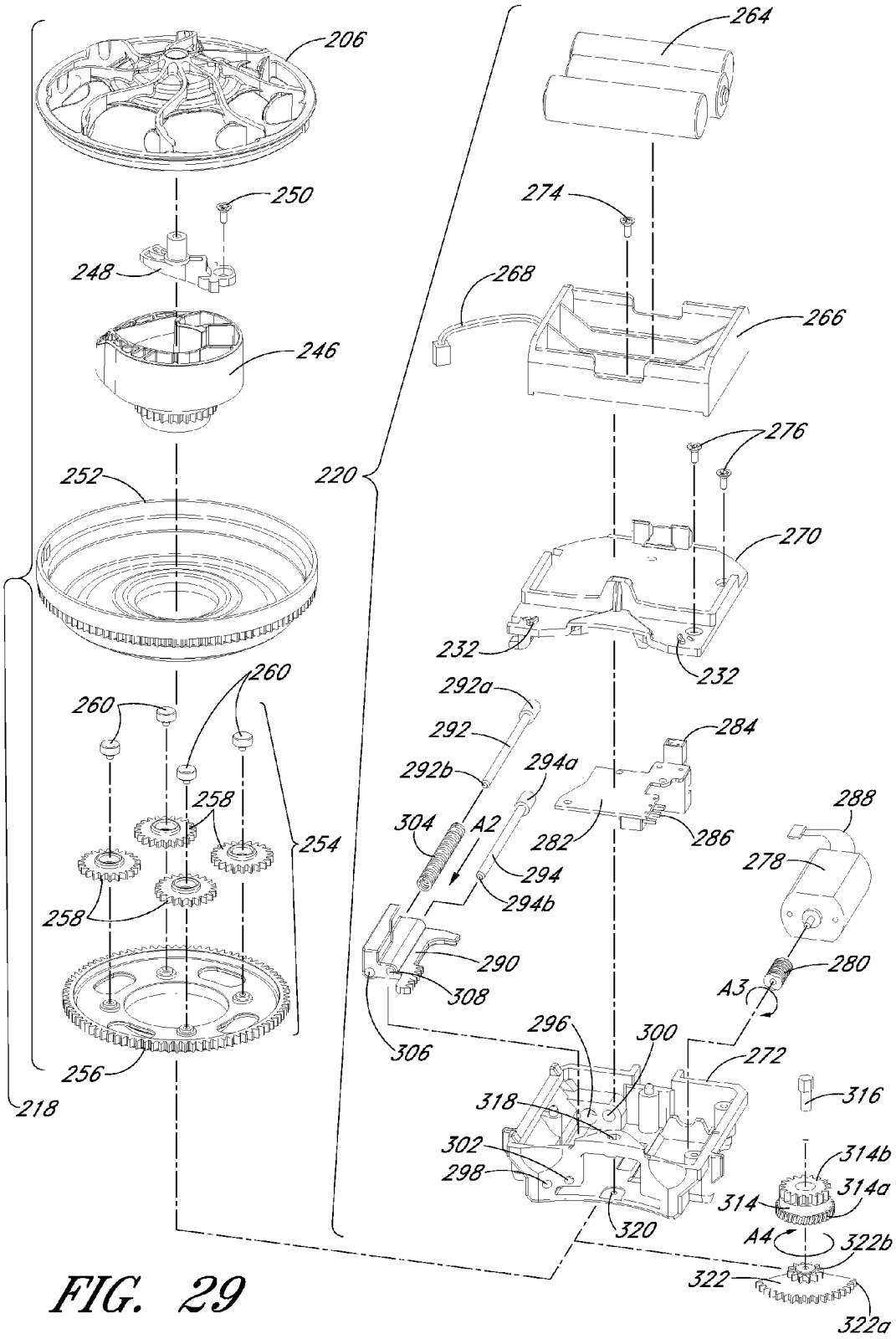
FIG. 29 is an exploded assembly view of the embodiment of the drive assembly shown in FIGS. 27 and 28.

FIG. 29 is an exploded assembly view of the embodiments of the rotor assembly 218 and the drive motor assembly 220 shown in FIGS. 27 and 28. As illustrated therein, in some embodiments, the rotor assembly 218 can comprise the rotor member 206, a rotor arm member 246, a support member 248 removably attached to a rotor arm member 246 using a fastener 250, a rotor base member 252, and a planetary gear assembly 254 comprising a first gear member 256 and a plurality of a second gears 258 attached to the first gear member 256 using a plurality of fasteners 260. The second gears 258 can be supported by the first gear member 256 in such a way that each of the second gears 258 are each able to rotate about its own axis, independent of the first gear member 256.

As illustrated in FIG. 29, the drive motor assembly 220 can have one or more batteries or other suitable power sources 264, a battery housing 266 having a connector wire 268, an upper housing member 270, and a lower housing member 272. In some embodiments, the battery housing 266 can be removably attached to the upper housing member 270 using a fastener 274. In some embodiments, the upper housing member 270 can be removably attached to the lower housing member 272 using one or more fasteners 276. Additionally, a drive motor 278 configured to rotate a worm gear 280 can be supported within the lower housing member 272. In some embodiments, the lower housing member 272 can also support a controller or circuit board 282. The circuit board 282 can include a first wire connector 284 configured to receive the connector wire 268 from the battery housing 266, and a second wire connector 286 configured to receive the wire connector 288 from the electric motor 278.

In some embodiments, a switch gear 290 configured to interact with a switching mechanism (not illustrated) located on the circuit board 282 can also be supported within the lower housing member 272. In particular, with reference to FIG. 29, the switch gear 290 can be supported on a first bolt or threaded shaft 292 and a second bolt or threaded shaft 294. In some embodiments, the first threaded shaft 292 can be inserted from the outside of the lower housing member 272 into a first opening 296 formed in the lower housing member 272. In this configuration, the first opening 296 can be configured to receive and support at least a first end portion 292*a* of the first threaded shaft 292. A second opening 298 formed in the lower housing member 272 can be configured to threadably receive a second end portion 292*b* of the first threaded shaft 292. In some embodiments, the second threaded shaft 294 can be inserted from the outside of the lower housing member 272 into a third opening 300 formed in the lower housing member 272. In this configuration, the third opening 300 can be configured to receive and support at least a first end portion 294*a* of the second threaded shaft 294. A fourth opening 302 formed in the lower housing member 272 can be configured to threadably receive a second end portion 294*b* of the second threaded shaft 294.

The drive motor assembly 220 can be assembled so that the first shaft member 292 supports a spring member 304 thereon and so that the first shaft member 292 passes through a first opening 306 formed in the switch gear 290. As will be discussed, the spring member 304 can exert a biasing force on the switch gear 290 in the direction represented by arrow A2 shown in FIG. 29. In some embodiments, the amount of force exerted by the spring member 304 on the switch gear 290 can be increased or decreased by threading or unthreading, respectively, the first threaded shaft 292 into or out of, respectively, the opening 298 formed in the lower housing member 272. Thus, the force exerted by the spring member 304 can be selectable or adjusted in this or any other suitable manner. In some embodiments, the biasing force can be selectable or adjusted by changing the tension of the spring member 304.

Additionally, the drive motor assembly 220 can be assembled so that the second shaft member 294 passes through a second opening 308 formed in the switch gear 290. In this arrangement, the switch gear 290 can be supported on the first and second threaded shaft 292, 294 so that the switch gear 290 can translate axially relative to the first and second threaded shafts 292, 294. The spring member 304 can be configured to exert a biasing force on the switch gear 290 in the direction defined by arrow A2 shown in FIG. 29.

As will be described in greater detail below, as the switch gear 290 moves axially along the two shafts 292, 294 in a direction that is opposite to the direction of the arrow A2 to a particular predetermined position or switch point, as the switch gear 290 can activate a switching mechanism (not illustrated) supported by the circuit board 282 to turn off the motor 278. When the switch gear 290 moves back away from the circuit board 282 (i.e., in the direction defined by arrow A2) beyond the switch point, the switching mechanism can then be turned back on to allow the motor 278 to operate.

As mentioned, when the motor 278 operates, the motor 278 can turn the worm gear 280 in the direction defined by arrow A3 in FIG. 29. The worm gear 280 can then interact with a lowermost gear 314*a* of the gear member 314, turning the gear member 314 in the direction defined by arrow A4 in FIG. 29. In some embodiments, the lowermost gear 314*a* can be integrally formed with an uppermost gear 314*b* to form a single, integrated unit that rotates as a single entity. The gear member 314 can be supported about a shaft 316 that can be supported by the openings 318, 320 formed in the lowermost housing member 272. Additionally, a second gear member 322 can also be supported by the shaft 316. The second geared member 322 can have a lowermost gear member 322*a* and an uppermost gear member 322*b*.

In some embodiments, the motor assembly 220 can be configured such that the gear member 314 can only rotate in a single direction. For example, the gear member 314 can rotate in a direction defined by arrow A4, but not in the opposite direction. The gear member 314 can have an internal bearing system configured to allow the gear member 314 to rotate in a first direction, but not in a second direction opposite the first direction. In some embodiments, the shaft 316 can be configured to have features to permit the gear member 314 to rotate in a first direction, but not in a second direction opposite the first direction. In some embodiments, the first gear member 314 can be configured to rotate independent about the shaft 316 relative to the second gear member 322.

Figure 30:
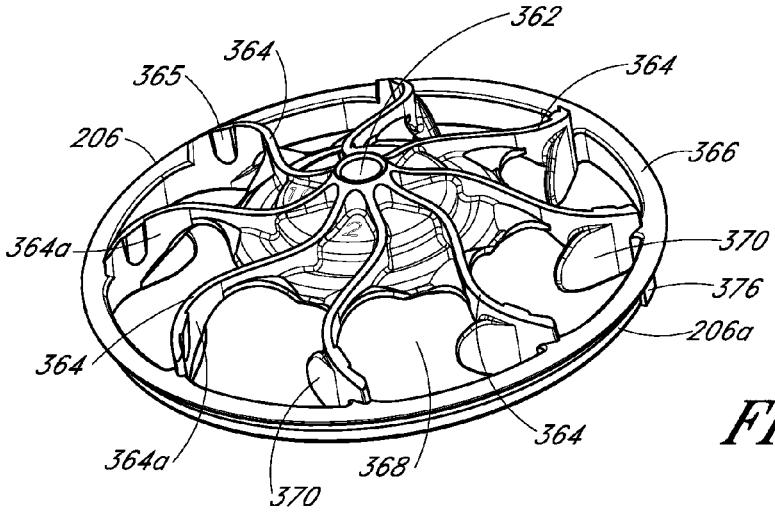
FIG. 30 is a perspective view of the top portion of the embodiment of the rotor member shown in FIG. 29.
Figure 31:
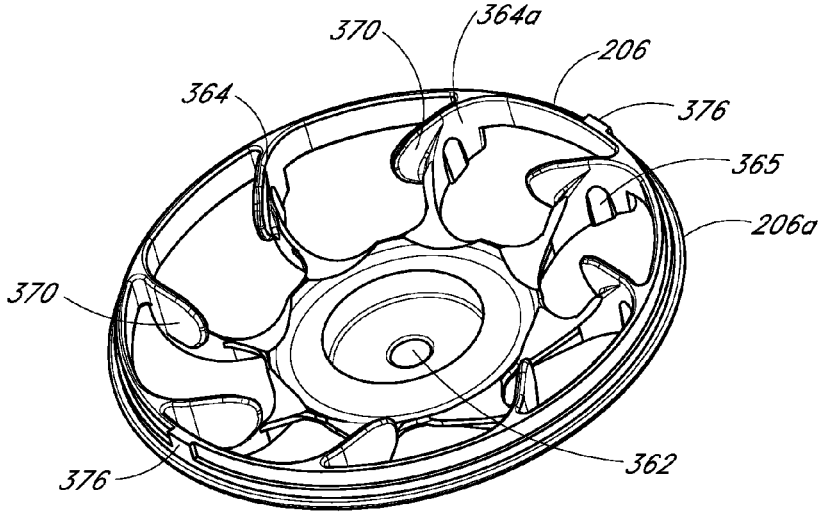
FIG. 31 is a perspective view of the bottom portion of the embodiment of the rotor member shown in FIG. 29.
Figure 33:
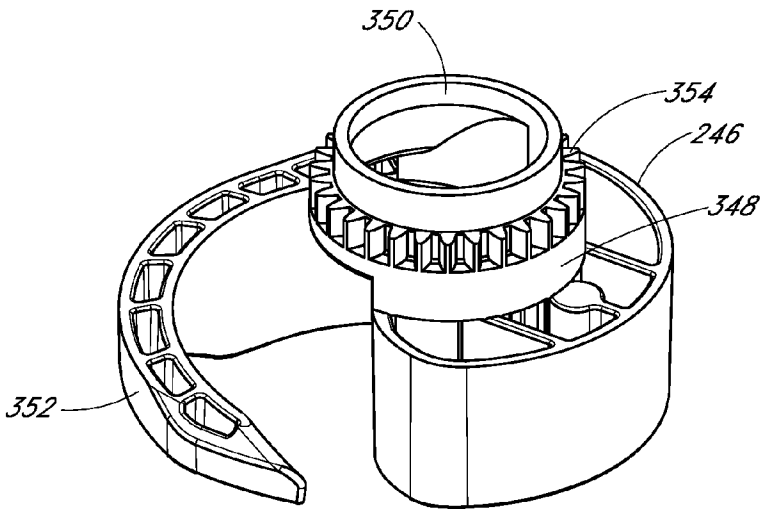
FIG. 33 is a perspective view of the bottom portion of the embodiment of the rotor arm member shown in FIG. 29.
Figure 32:
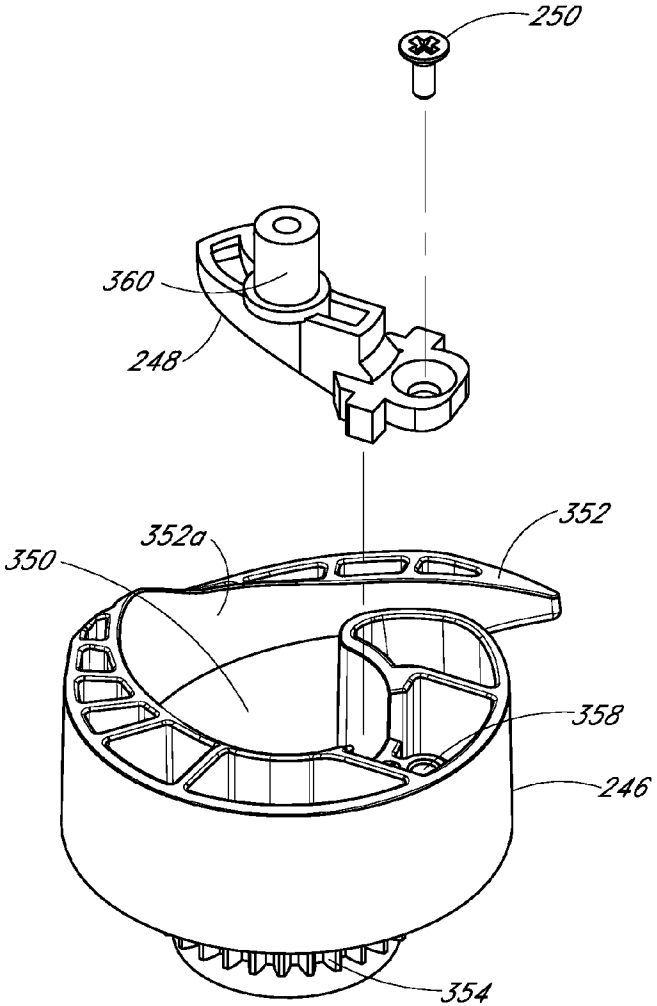
FIG. 32 is an exploded perspective view of the embodiment of the support member and the embodiment of the rotor arm member shown in FIG. 29.
Figure 35:
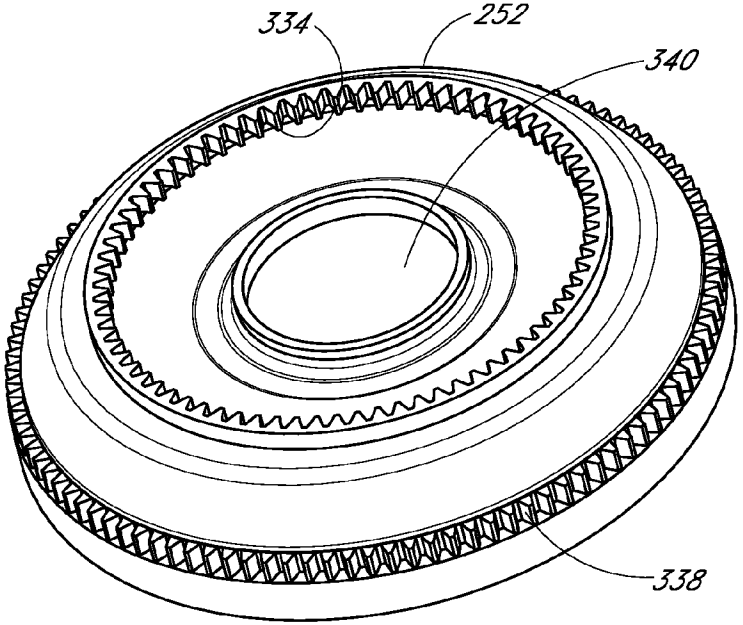
FIG. 35 is a perspective view of the bottom portion of the embodiment of the rotor base member shown in FIG. 29.
Figure 34:
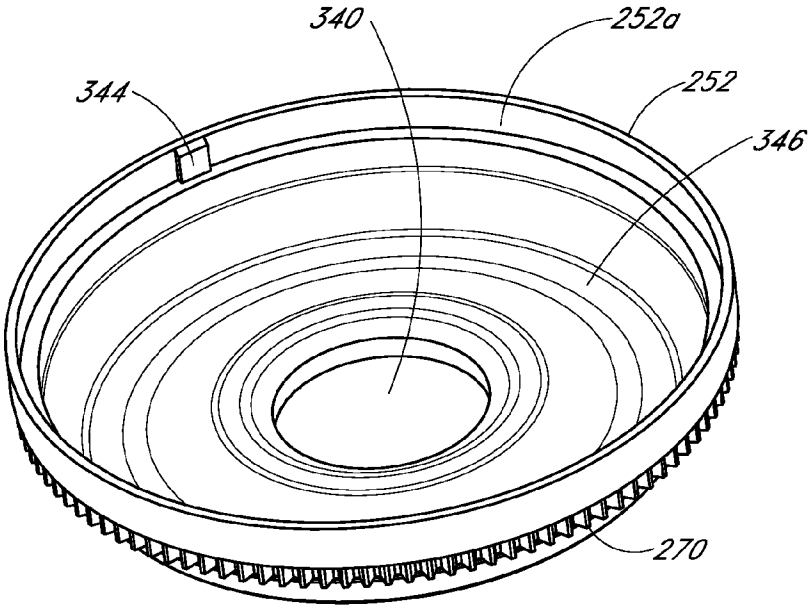
FIG. 34 is a perspective view of the top portion of the embodiment of the rotor base member shown in FIG. 29.
Figure 36:
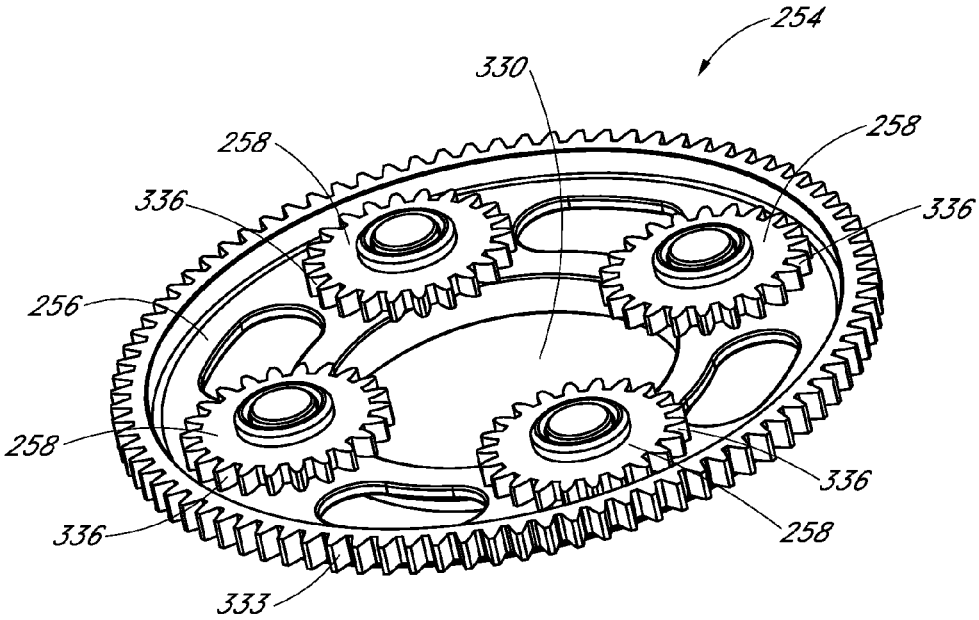
FIG. 36 is a perspective view of the top portion of the embodiment of the planetary gear member shown in FIG. 29.
Figure 37:
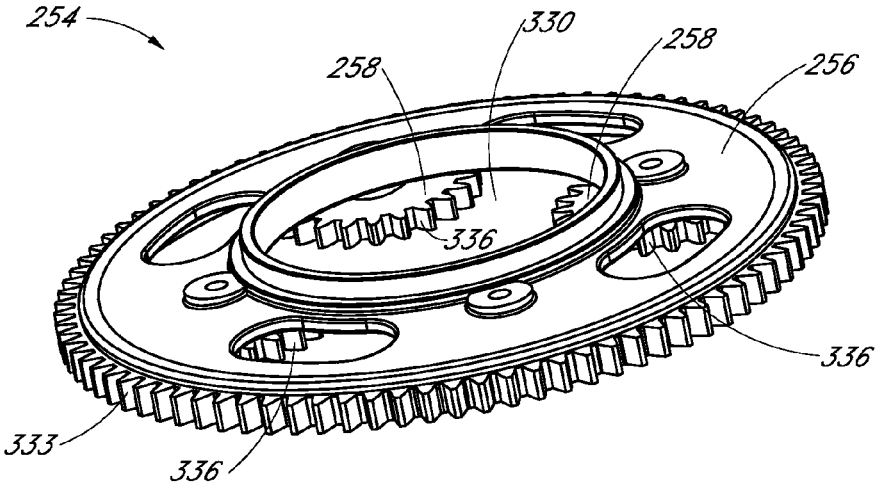
FIG. 37 is a perspective view of the bottom portion of the embodiment of the planetary gear assembly shown in FIG. 29.
Figure 38:
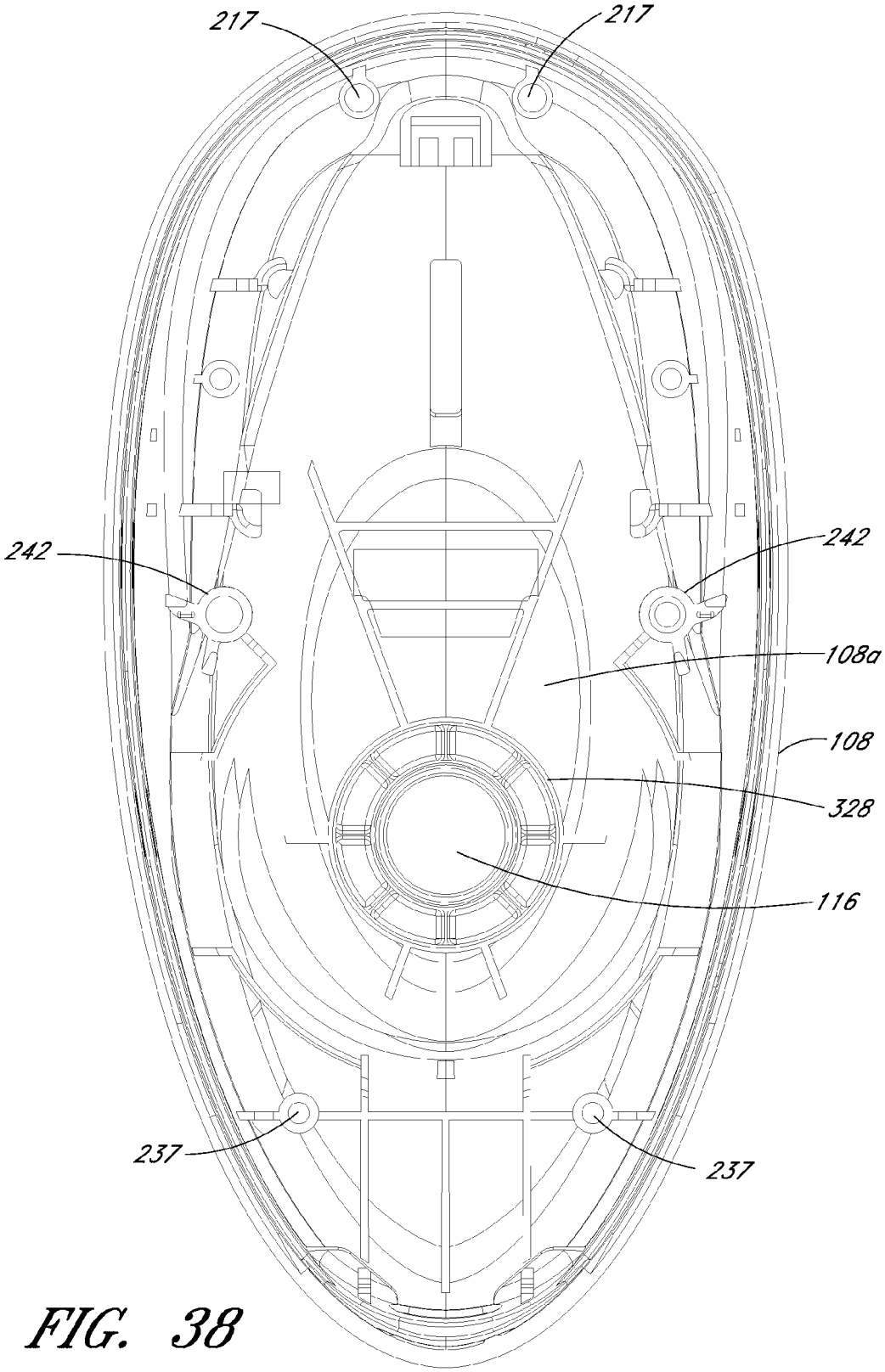
FIG. 38 is a top view of the embodiment of the lower shell member shown in FIG. 28.
Figure 39:
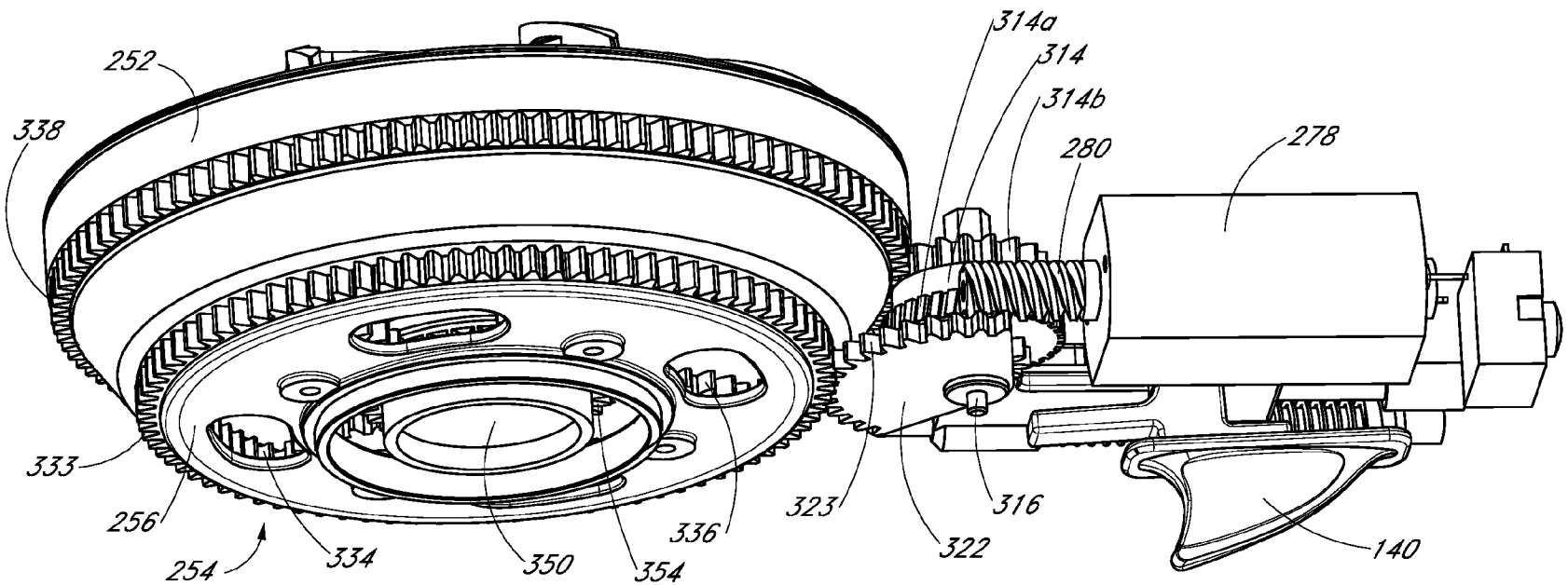
FIG. 39 is a perspective view of the bottom portion of a portion of the components comprising the embodiment of the feeder assembly and the embodiment of the drive motor assembly shown in FIG. 29.

FIGS. 30 and 31 are perspective views of the top and bottom portion, respectively, of the embodiment of the rotor member shown in FIG. 29. FIG. 32 is an exploded perspective view of the embodiment of the support member 248 and the embodiment of the rotor arm member 246 shown in FIG. 29. FIG. 33 is a perspective view of the bottom portion of the embodiment of the rotor arm member 246 shown in FIG. 29. FIGS. 34 and 35 are perspective views of the top and bottom portion, respectively, of the embodiment of the rotor base member shown in FIG. 29. FIGS. 36 and 37 are perspective views of the top and bottom portion, respectively, of the embodiment of the planetary gear assembly 254 shown in FIG. 29. FIG. 38 is a top view of the embodiment of the lower shell member 108 shown in FIG. 28. FIG. 39 is a perspective view of the bottom portion of a portion of the components comprising the embodiment of the feeder assembly 218 and the embodiment of the drive motor assembly 220 shown in FIG. 29.

Figure 41:
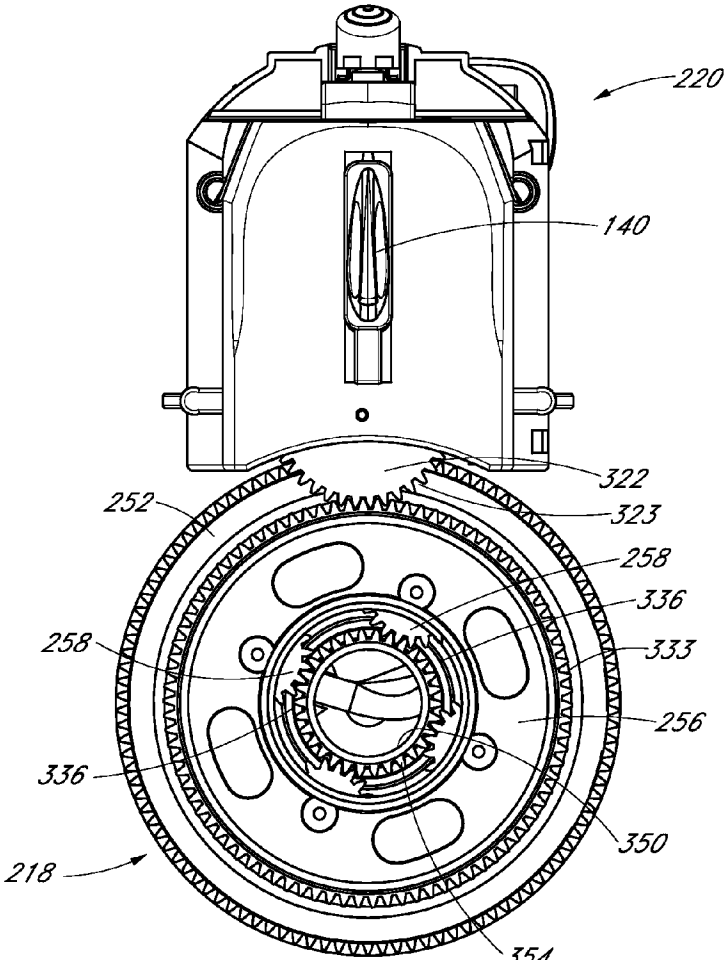
FIG. 41 is a bottom view of a portion of the components comprising the embodiment of the feeder assembly and the embodiment of the drive motor assembly shown in FIG. 29.
Figure 40:
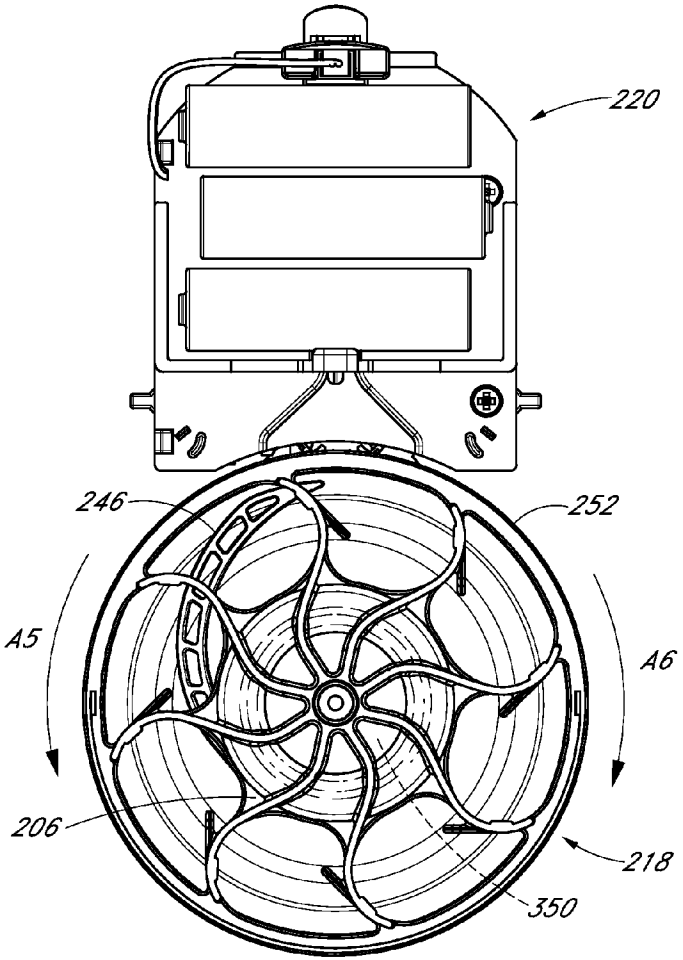
FIG. 40 is a top view of a portion of the components comprising the embodiment of the feeder assembly and the embodiment of the drive motor assembly shown in FIG. 29.

FIGS. 40-41 are a top and bottom view, respectively, of a portion of the components comprising the embodiment of the feeder assembly 218 and the embodiment of the drive motor assembly 220 shown in FIG. 29.

With reference to FIGS. 29-39, the feed assembly 218 can be assembled by positioning the planetary gear assembly 254 in the lower shell member 108 so that the annular lip 326 projecting away from the bottom surface 256*a* of the first gear 256 of the planetary gear assembly 254 can be supported adjacent to, but inside of, the annular lip 328 that can project away from the bottom surface 108*a* of the lower shell member 108. The annular lip 328 formed in the lower shell member 108 can be positioned coaxially with respect to the opening 116 formed in the lower shell member 108. In this configuration, the planetary gear assembly 254 can generally rotate freely relative to the lower shell member 108, but can be constrained by the abutting annular lips 326, 328 from translating in any radial direction. Further, in this configuration, the planetary gear assembly 254 can be supported by the lower shell member 108 so that the opening or passageway 330 formed in the planetary gear assembly 254 is generally coaxially aligned with the opening 116 formed in the lower shell member 108. Additionally, as most clearly illustrated in FIG. 41, the first gear 256 of the planetary gear assembly 254 can have a geared surface 333 that can be configured to interact with the geared surface 323 formed on the second gear member 322 supported by the shaft 316.

After the planetary gear assembly 254 has been assembled with the lower shell member 108 as described above, the rotor base member 252 can then be assembled with the planetary gear assembly 254 so that the first geared surface 334 of the rotor base member 252 aligns with and meshes with the geared surface 336 on each secondary gear 258 of the planetary gear assembly 254. In this configuration, the rotor base member 252 can rotate independent of the first gear member 256 of the planetary gear assembly 254. However, because of the interaction between the first geared surface 334 of the rotor base member 252 and the geared surface 336 on each secondary gear 258, as the rotor base member 252 rotates independent of the first gear member 256, each secondary gear 258 will be caused to rotate.

Additionally, the rotor base member 252 can have a second geared surface 338 configured to mesh with and engage with the uppermost gear 314*b* of the gear member 314 (as most clearly shown in FIG. 38) so that, as the drive motor 278 turns the gear member 314, the gear member 314 can turn or rotate the rotor base member 252. The rotor base member 252 can have an opening or passageway 340 formed therein configured such that, when the rotor base member 252 is assembled with the planetary gear assembly 254, the opening 340 can be generally axially aligned with the opening 116 formed in the lower shell member 108. Additionally, as will be described in greater detail below, the rotor base member 252 can be configured to receive and support the rotor arm member 246.

Some embodiments of the rotor base member 252 can define one or more tabbed protrusions 344 formed on an inside surface 252*a* of the rotor base member 252. In the illustrated embodiment, two tabbed protrusions 344 are formed on opposing sides of the inside surface 252*a* of the rotor base member 252, the tabbed protrusions 344 being separated by approximately 180°. As will be described in greater detail below, the one or more tabbed protrusions can be formed on in a side surface of the rotor member 206, such tabbed protrusions being configured to interact with the tabbed protrusions 344 formed on the rotor base member 252 to limit the range of rotation of the rotor member 206 relative to the rotor base member 252 and to drive the rotor member 206 as the rotor base member 252 is rotated. In some embodiments, the rotor base member 252 can have an annular channel 346 formed therein, the channel 346 being configured to receive end of support a plurality of paintballs (not illustrated).

As mentioned, the rotor base member 252 can be configured to receive and support the rotor arm member 246. In particular, in some embodiments, the rotor base member 252 can be configured to support the rotor arm member 256 such that the generally cylindrical protruding portion 348 projecting from the rotor arm member 246 can be received within the opening 340 formed in the rotor base member 252. With reference to FIGS. 32 and 33, an opening or passageway 350 can be formed in the protruding portion 348, the opening 350 being sized and configured to permit the generally uninhibited flow of paintballs therethrough. Additionally, in some embodiments, the rotor arm member 246 can have an arm 352 protruding therefrom, the arm 352 defining a generally curved, arcuate, helical, or other suitable shape. The arm 352 can have an inside surface 352*a* configured to guide one or more paint balls toward the opening 350 as the rotor arm member 256 rotates within the rotor base member 252, as will be described in greater detail below. The support member 248 can be configured so as to not obstruct the designated flow path for the paintballs through the opening 350.

The rotor arm member 246 can be configured to have two or more arms 352 protruding therefrom. For example, the rotor arm member 246 can be configured to have two arms 352 protruding therefrom, being formed at mutually opposing positions. The rotor arm member 246 can be configured such that each of the two arms 352 feed paintballs through each of the two separate openings 350, respectively, formed in the rotor arm member 256. Each of the two openings 350 can be configured to merge within the rotor arm member 246, or the two openings 350 can terminate at the bottom end of the rotor arm member 246. The rotor arm member 246 can be configured to comprise only one opening 250, through which each of the two arms 352 can feed the paintballs during operation.

Some embodiments of the rotor arm member 246 can have a geared surface 354 formed on a portion of the generally cylindrically shaped protrusion 342. As most clearly illustrated in FIG. 41, the geared surface 354 can be configured to interact with the geared surface 336 of each secondary gear 258 when the rotor arm member 246 has been assembled with the rotor base member 252 and the planetary gear 254.

In some embodiments, the loader 100 can be configured so that the rotor arm member 246 rotates at a different speed than the rotor base member 252. For example, the rotor arm member 246 can rotate approximately three times for every one rotation of the rotor base member 252. In some embodiments, the loader 100 can be configured so that the rotor arm member 246 rotates less than approximately three times (e.g., approximately two times or less) for every one rotation of the rotor base member 252. In some embodiments, the loader 100 can be configured so that the rotor arm member 246 rotates more than approximately three times (e.g., approximately four times or more) for every one rotation of the rotor base member 252.

Additionally, as most clearly illustrated in FIG. 32, the support member 248 can be removably supported by the rotor arm member 246 using the fastener 250. Some embodiments of the rotor arm member 246 can have a threaded opening 358 configured to receive the threaded fastener 250. However, any suitable fastener or fastening technique can be used to join the support member 248 with the rotor arm member 246, including but not limited to adhesive, rivets, plastic welding, or otherwise. In some embodiments, the support member 248 can be integrally formed with the rotor arm member 246. The support member 248 can have a generally cylindrical protrusion 360 configured to be received by an opening 362 formed in the rotor member 206, so that the rotor member 206 can be supported thereby.

In some embodiments, the support member 248 can be spring loaded or otherwise configured so that the support member 248 exerts a downward biasing force relative to the rotor arm member 246. This can result in an increased force being exerted on the paintballs, causing the paintballs to be forced through the opening 116 in the housing 106. Accordingly, some embodiments of the support member 248 (not illustrated) can have a spring member positioned between the fastener 250 and the support member 248.

In some embodiments, the support member 248 can be spring loaded or otherwise configured so that the support member 248 exerts an upward biasing force relative to the rotor arm member 246. This can result in fewer paintball jams during operation. Accordingly, the support member 248 can have a spring member positioned between the support member 248 and the rotor arm member 246.

In some embodiments, the rotor member 206 can be configured to direct the paintballs toward the center of the feeder assembly 218 and, hence, toward the opening 350 formed in the rotor arm member 246. With reference to FIG. 30-31, the rotor member 206 can be configured to have a plurality of wall portions 364 between the approximate center portion in the rotor member 206 and an outer perimeter portion 366 of the rotor member 206. In some embodiments, each of the wall portions 364 can define a generally curved or arcuately shaped surface 364*a* thereon and a plurality of openings 368 each configured to receive a single paintball. The illustrated embodiment of the rotor member 206 has eight openings 368. In some embodiments, less than eight or greater than eight openings 368 can be formed in the rotor member 206. Each of the wall portions 364 can be configured to channel or direct the paintballs to the plurality of openings 368 formed in the rotor member 206, as illustrated.

Additionally, in some embodiments, each of the wall portions 364 can be configured to have be tabbed protrusion 370 sized and shaped to optimally direct a single paint ball into each of the openings 368 and to rotate the paintballs relative to the rotor base member 252. Finally, as mentioned above, the rotor member 206 can have one or more tabbed protrusions 376 formed on an outside surface 206*a* of the rotor member 206, configured to interact with the one or more tabs 344 formed along the rotor base member 252 to limit the range of rotation of the rotor member 206 relative to the rotor base number 252.

Further, some embodiments of the rotor member 206 can have one or more angled protrusions 365 formed on the one or more of the surfaces 364*a*. In the illustrated embodiment, one angled protrusion 365 is formed on each surface 364*a*. The angled protrusions 365 can bias the paintballs positioned in the openings 368 and a downward direction so as to inhibit the paintballs positioned in the openings 368 from moving in an upward direction out of the openings 368.

In some embodiments, the angled protrusions 365 can each define an angle that is less than approximately three degrees relative to a vertical plane (i.e., a plane that is parallel to the axial centerline of the rotor member 206). The angled protrusions 365 can each define an angle that is less between approximately three degrees and approximately eight degrees relative to a vertical plane (i.e., a plane that is parallel to the axial centerline of the rotor member 206). In some embodiments, the angled protrusions 365 can each define an angle that is greater than approximately eight degrees relative to a vertical plane (i.e., a plane that is parallel to the axial centerline of the rotor member 206).

In some embodiments, the rotor member 206 is formed from two or more different materials having different material properties. For example, the rotor member 206 can be formed from two or more different materials, wherein a more flexible material can be used to form the features of the rotor member 206 where increased flexibility is desired (e.g., at the portions of the rotor member 206 at which paintball jams are more likely to occur). In particular, the rotor member 206 can be formed such that the tabbed protrusions 370 are made from a material that is more flexible than the material used to form the wall portions 364 of the rotor member 206. Additionally, some portions of the rotor member 206 (such as the curved surface 364*a*) can have a smoother surface texture than other portions of the rotor member 206.

The tabbed protrusions 370 can be formed separately from some of the other components comprising the rotor member 206, and can be hingedly supported by the rotor member 206. In some embodiments, spring members are positioned adjacent to each of the tabbed protrusions 370 so that the tabbed protrusions 370 can flex and/or can exert a spring-like force on one or more of the paintballs.

Additionally, the rotor member 206 can be configured to have fewer wall portions 364 than the number of tabbed protrusions 370. For example, one or more of the tabbed protrusions 370 can be supported by the perimeter portion 366 of the rotor member 206, such that the wall portions 364 are not positioned adjacent to all of the tabbed protrusions 370. For example, the rotor member 206 can have a total of eight tabbed protrusions 370, but only four wall portions 364.

With reference to FIG. 40, when the drive motor 278 is activated, the worm gear 280 can drive the gear member 314 and, consequently, the base rotor member 252 as described above. In this configuration, the base rotor member 252 can be rotated in the direction defined by arrow A5 shown in FIG. 40. As the base rotor member 252 rotates in the direction A5, the base rotor member 252 can cause the second gears 258 to rotate as described above. As the second gears 258 rotate, in this configuration, the second gears 258 can cause the rotor arm member 246 to rotate in the direction represented by arrow A6 illustrated in FIG. 40. As illustrated therein, the direction represented by arrow A6 is in the opposite direction as compared to the direction represented by arrow A5. Thus, in this configuration, when the drive motor 278 is activated, the rotor member 246 can be caused to generally counter-rotate relative to the rotor base member 252 and, accordingly, counter-rotate relative to the rotor member 206.

As will now be described, some embodiments of the loader 100 can be configured to have a switching mechanism configured to selectively stop the operation of the feeder assembly 218 when, for example, a sufficient number of paintballs have been fed into the marker and have backed up in the opening 116 formed in the lower shell member 108. In this state, when a sufficient number of paintballs have been fed into the marker such that the paintballs have backed up in the opening 116, to provide for a more efficient use of the drive motor assembly 220 and to reduce the force exerted by the feeder assembly 218 on the paintballs, in some embodiments, the loader 100 can be configured as described below.

Figure 43:
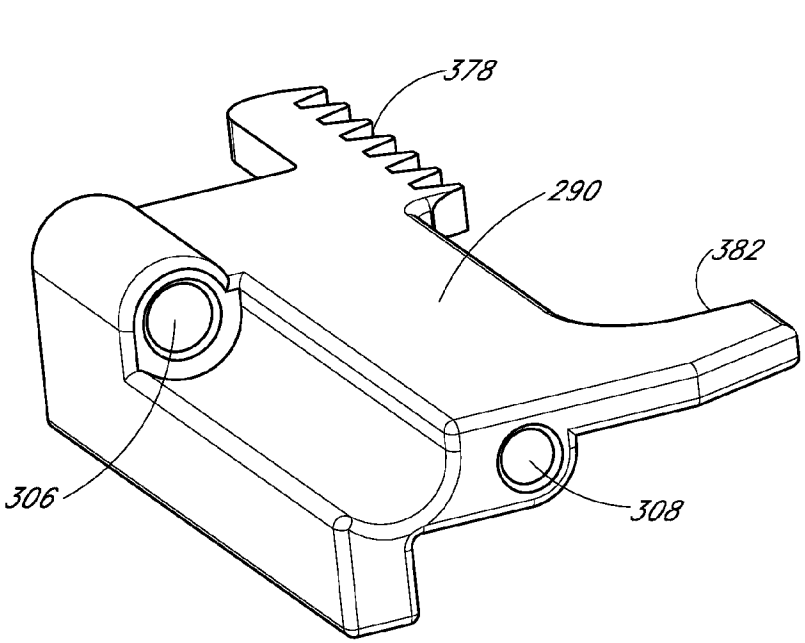
FIG. 43 is a perspective view of the bottom portion of the embodiment of the switch gear shown in FIG. 29.
Figure 42:
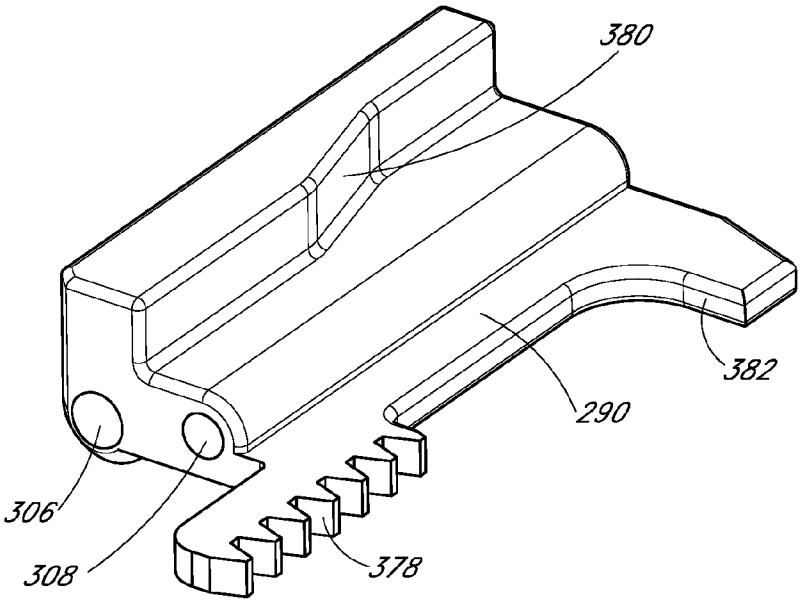
FIG. 42 is a perspective view of the top portion of the embodiment of the switch gear shown in FIG. 29.
Figure 44:
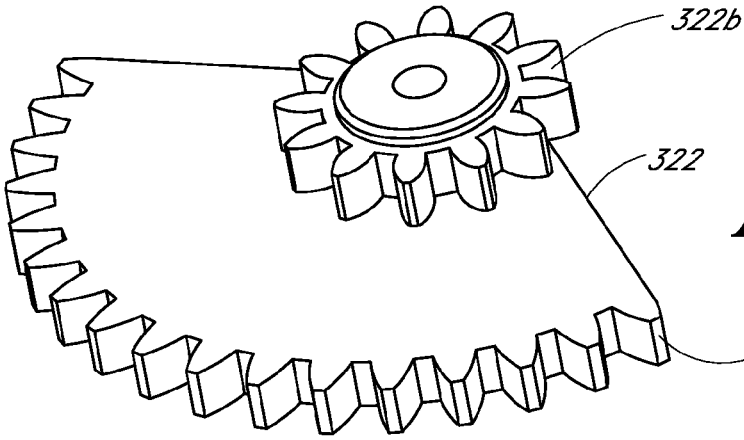
FIG. 44 is a perspective view of the top portion of the embodiment of the second gear member shown in FIG. 29.
Figure 45:
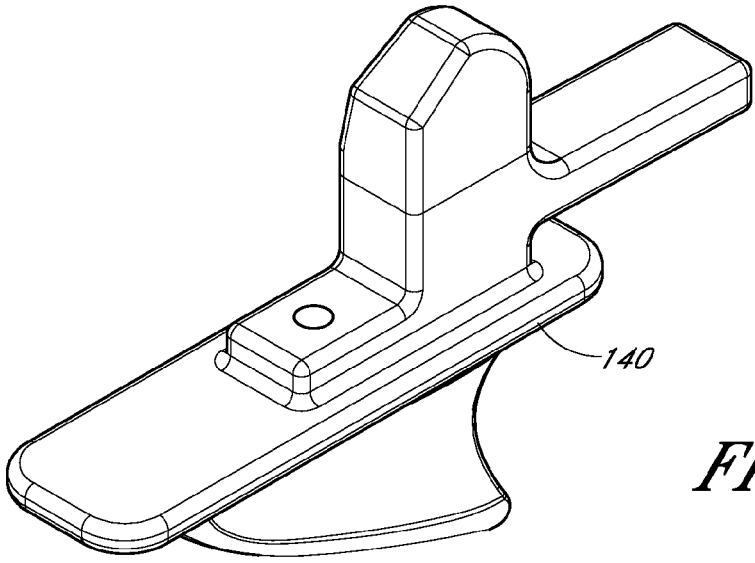
FIG. 45 is a perspective view of the top portion of the embodiment of the trigger member shown in FIG. 29.

FIGS. 42-43 are perspective views of the top portion and the bottom portion, respectively, of the embodiment of the switch gear 290 shown in FIG. 29. FIG. 44 is a perspective view of the top portion of the embodiment of the second gear member 322 shown in FIG. 29. FIG. 45 is a perspective view of the top portion of the embodiment of the trigger member 140 shown in FIG. 29. FIG. 46 is a bottom view of a portion of the components comprising the embodiment of the feeder assembly 218 and the embodiment of the drive motor assembly 220 shown in FIG. 29, showing the switch gear 290 and trigger member 140 in the first position. FIG. 46 is a bottom view of a portion of the components comprising the embodiment of the feeder assembly 218 and the embodiment of the drive motor assembly 220 shown in FIG. 29, showing the switch gear 290 and the trigger member 140 in the second position.

With reference to FIG. 42, in addition to the features described above, the switch gear 290 can have a notched or geared surface 378 configured to mesh and interact with the uppermost gear member 322*b* of the second gear member 322. Additionally, the switch gear 290 can have a switch surface 380 that, in some embodiments, can be slanted as illustrated in FIG. 42. The switch surface 380 can be configured to activate and deactivate a roller type switch that can be mounted on the circuit board 282 as the switch gear 290 translates along the shafts 292, 294 received within the openings 306, 308, respectively. In some embodiments, the range of translational motion of the switch gear 290 can be limited by the internal dimensions of the, or internal features formed on the, lower housing member 272. For example, in some embodiments, the range of translation of the switch gear 290 in the direction represented by arrow A7 can be limited by the contact of a portion of the switch gear 290 with the lower housing member 272.

Figure 46B:
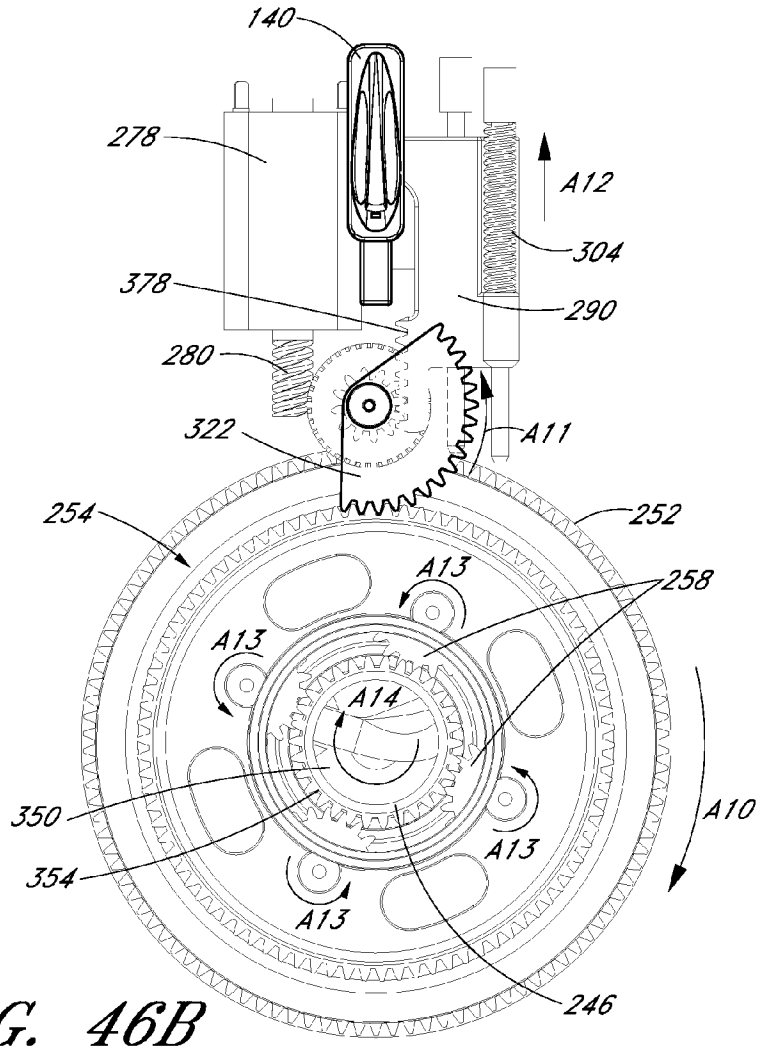
FIG. 46B is a bottom view of a portion of the components comprising the embodiment of the feeder assembly and the embodiment of the drive motor assembly shown in FIG. 29, showing the switch gear and the trigger member in the second position.
Figure 46A:
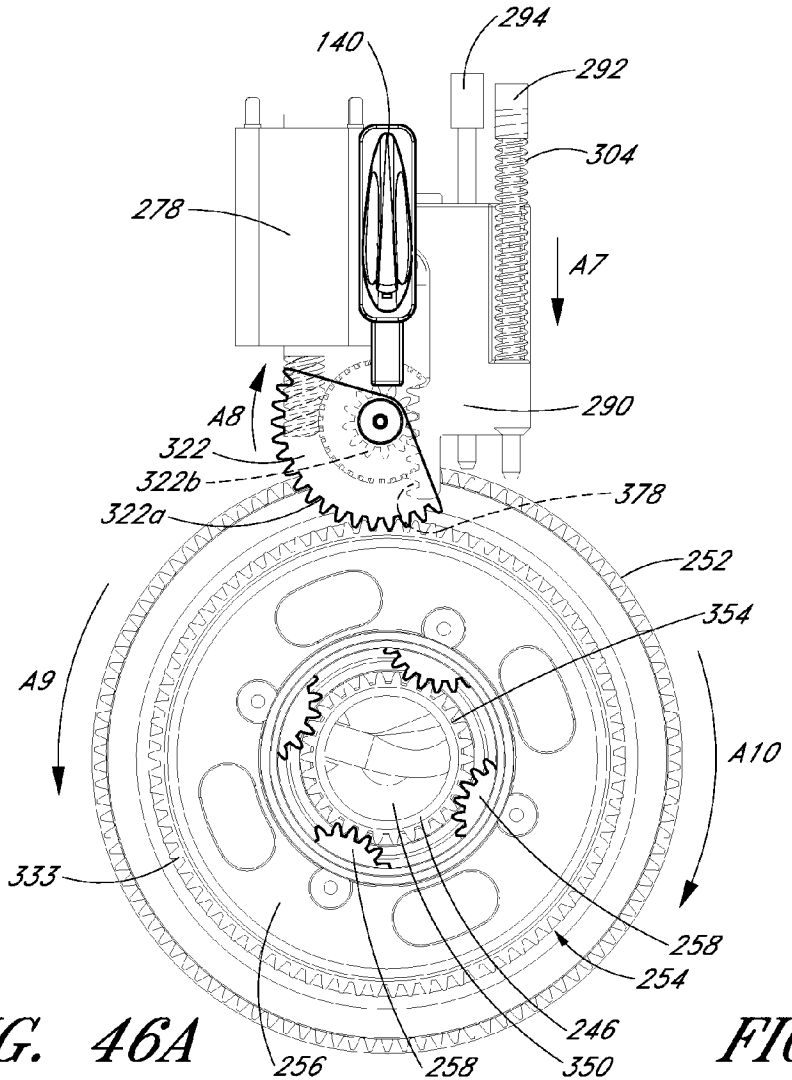
FIG. 46A is a bottom view of a portion of the components comprising the embodiment of the feeder assembly and the embodiment of the drive motor assembly shown in FIG. 29, showing the switch gear and trigger member in the first position.

As illustrated in FIG. 46A, in some embodiments, the spring member 304 mounted on the shaft 292 can exert a biasing force on the switch gear 290 in the direction of the arrow A7 shown in FIG. 46A. As illustrated in FIGS. 46A and 46B as described above, the geared surface 378 of the switch gear 290 can be configured to interact with the uppermost gear member 322*b* of the second gear member 322 such that the bias exerted by the spring member 304 on the switch gear 290 can result in a bias force being imparted by the switch gear 290 on the second gear member 322. This can cause the second gear member 322 to be biased in the direction represented by arrow A8 shown in FIG. 46A. Similarly, because the lowermost gear member 322*a* is rotationally fixed to the uppermost gear member 322*b*, and because the lowermost gear member 322 can be configured to mesh and interact with the geared surface 333 of the first gear member 256 of the planetary gear assembly 254, the bias exerted on the second gear member 322 can result in a bias being exerted on the first gear member 256 of the planetary gear assembly 254 in the direction represented by arrow A9 shown in FIG. 46A.

Thus, in total, in some embodiments, the spring member 304 can result in a bias being exerted on the first gear member 256 of the planetary gear assembly 254 in the direction represented by arrow A9 shown in FIG. 46A. The bias force being exerted on the first gear member 256 of the planetary gear assembly 254 can hold the first gear member 256 of the planet gear assembly 254 in a stationary rotational position as the rotor base member 252 is rotated by the drive motor 276 in the direction represented by arrow A10 FIG. 46A.

In some embodiments, if the rotor seat assembly 218 becomes filled with paintballs such that the rotor arm member 246 is prevented from counter-rotating relative to the rotor base member 252, the binding of the rotor arm member 246 by the paintballs can cause the rotor arm member 246 to rotate each of the second gears 258 against the force of the bias from the spring member 304 so that the first gear 256 of the planetary gear assembly 254 can be caused to rotate in the direction defined by arrow A10. Of course, the first gear 256 of the planetary gear assembly 254 will not be caused to rotate in the direction defined by arrow A10 unless the force exerted on the planetary gear assembly 254 from the rotor arm assembly 256 is greater than the force exerted on the planetary gear assembly 254 from the spring member 304, as described above.

However, if the bias force exerted by the spring member 304 is overcome, the first gear member 256 can rotate, causing the second gear member 322 to rotate in the direction defined by arrow A11 shown in FIG. 46B. The rotation of the second gear member 322 in the direction defined by arrow A11 can in turn cause the switch gear 290 to translate in the direction represented by arrow A12 in FIG. 46B, toward the second position of the switch gear 290 illustrated in FIG. 46B. When the switch gear 290 translates a predetermined threshold distance in the direction represented by arrow A12, a roller switch (not illustrated) that can be mounted on the circuit board 282 can be caused to depress the switch, closing the circuit of power to the drive motor 278 and, hence, stopping the feeder assembly 218 from rotating any further until the bias force exerted by the spring member 304 on the switch gear 290 overcomes the force exerted on the switch gear 290 by the second gear member 322 and the switch gear 290 returns to the first position, as illustrated in FIG. 46A.

Additionally, in some embodiments, as illustrated in FIGS. 46A-46B, the trigger member 140 can be used to cause the rotor arm member 246 to rotate relative to the rotor member 206 to clear any paintball jams that may exist in the feeder assembly 218. For example, if a paintball jam has caused the switch gear 292 move to the second position, as illustrated in FIG. 46B, such that the switch has turned the power off to the drive motor 278, the trigger member 240 can be pulled or translated in the direction represented by arrow A12 in FIG. 46B. In this state, where the switch has switched off the power to the drive motor 278, the loader 100 can be configured such that drive motor 278 is essentially frozen so as to prevent the rotor base member 252 from rotating in any direction. In this state, the loader 100 can be configured such that, translating the trigger member 140 in the direction represented by arrow A12 can cause the trigger member 140 to engage and also translate the switch gear 290 in the direction represented by arrow A12. This can cause the second gear member 322 to rotate in the direction defined by arrow A11 in FIG. 46B causing the first gear 256 of the planetary gear assembly 254 to rotate in the direction defined by arrow A10 in FIG. 46B. This can cause each of the second gears 258 to rotate in the direction of defined by arrows A13 in FIG. 46B, which can in turn cause the rotor arm member 246 to rotate in the direction represented by arrow A14 shown in FIG. 46B.

For reference, when the rotor arm member 246 rotates in the direction represented by arrow A14, the rotor arm member 246 will be rotating in the opposite direction as compared to when the feeder assembly 218 is operating in the feed direction and, hence, feeding paintballs through the opening 116 formed in the lower housing member 108. In other words, operating the trigger member 140 can cause the rotor arm member 246 to rotate in a backwards direction, causing any paintball that are jammed in the feeder assembly 218 to become dislodged or unjammed.

In some embodiments, the casing 106 can be configured to have a capacity to hold up to approximately 200 paintballs or less. In some embodiments, the casing 106 can be configured to have a capacity to hold up to approximately 300 paintballs, or, in some embodiments, up to approximately 400 paintballs or more. In some embodiments, the loader 100 can be configured to feed paintballs through the opening 116 formed in the lower shell member 108 at a rate of approximately 40 or more paintballs per second. In some embodiments, the loader 100 can be configured to feed paintballs through the opening 116 formed in the lower shell member 108 at a rate of approximately 50 or more paintballs per second. In some embodiments, the loader 100 can be configured to feed paintballs through the opening 116 formed in the lower shell member 108 at a rate of approximately 60 or more paintballs per second.

In some embodiments, any of the suitable components comprising the loader 100 can be molded or otherwise formed from nylon, delrin, polycarbonate, polyurethane, or any other suitable plastic or other material, or combination thereof. In some embodiments, any of the suitable components comprising the loader 100 can be formed from a fiber reinforced material, such as glass or carbon reinforced plastics, or a combination of fiber reinforced materials and any other suitable materials.

The embodiments of the loader described herein can include any of the components, features, details, or any other aspect of the embodiments of the loader described in U.S. patent application Ser. No. 11/258,100, titled Paintball Loader, filed on Oct. 26, 2005, the entirety of which is hereby incorporated by reference as if fully set forth herein.

Although the inventions have been disclosed in the context of a certain preferred embodiments and examples, it will be understood by those skilled in the art that the present disclosure extends beyond the specifically disclosed embodiments to other alternative embodiments and/or uses of the embodiments and obvious modifications and equivalents thereof. In addition, while a number of variations of the embodiments have been shown and described in detail, other modifications, which are within the scope of this disclosure, will be readily apparent to those of skill in the art based upon this disclosure. It is also contemplated that various combinations or subcombinations of the specific features and aspects of the embodiments may be made and still fall within the scope of the disclosure. Accordingly, it should be understood that various features and aspects of the disclosed embodiments can be combine with or substituted for one another in order to form varying modes of the disclosed embodiments. Thus, it is intended that the scope of the present disclosure should not be limited by the particular disclosed embodiments described above but by a fair reading of the claims which follow.

What is claimed is:

1. A paintball loader for feeding one or more paintballs into a paintball marker, the loader comprising:

a rotor member having at least one rotor fin configured to rotate about an axis;

a rotor arm member having an opening and being configured to rotate about substantially the same axis;

a drive motor configured to rotate the rotor member and the rotor arm member; and a rotor base member and a planetary gear assembly comprising a first gear and a plurality of second gears, wherein rotation of the rotor base member rotates the rotor member and the plurality of second gears, and wherein the plurality of second gears rotate the rotor arm member.

2. The paintball loader according to claim 1, wherein the rotor member is inhibited from rotating in the second direction.

3. The paintball loader according to claim 2, wherein the rotor member is inhibited from rotating more than approximately ninety degrees in the second direction.

4. The paintball loader according to claim 1 further comprising an actuator, wherein movement of the actuator rotates the rotor arm member in the second direction.

5. The paintball loader according to claim 1 further comprising a housing having a first body member and a second body member, the first body member being secured to the second body member without separate fasteners.

6. The paintball loader according to claim 5 further comprising a latch member for selectively securing the second body member to the first body member.

7. The paintball loader according to claim 5, wherein the second body member comprises an opening aligned with the axis of rotation for the rotor member and the rotor arm member.

8. The paintball loader according to claim 5, wherein at least a portion of the housing is translucent.

9. The paintball loader according to claim 1 further comprising a ramp member having a surface configured to contact the one or more paintballs, the surface moving between a first position and a second position as the one or more paintballs exit the opening.

10. The paintball loader according to claim 9, wherein the surface has a planar shape.

11. The paintball loader according to claim 9, wherein the ramp member is biased toward the second position.

12. The paintball loader according to claim 1 further comprising a cover member covering at least a portion of the drive motor.

13. The paintball loader according to claim 12, wherein the cover member is removably secured over the portion of the drive motor without separate fasteners.

14. The paintball loader according to claim 1, wherein the rotor arm member rotates at a different speed than the rotor base member rotates.

15. The paintball loader according to claim 1, wherein the rotor arm member rotates approximately three times as fast as the rotor base member.

16. The paintball loader according to claim 1, wherein the rotor arm member supports the rotor member.

17. The paintball loader according to claim 1, wherein at least one component of the group consisting of: the rotor member and the rotor arm member can be disassembled from the housing without the use of tools.

18. The paintball loader according to claim 1 further comprising a controller configured to cut off power to the drive motor when a predetermined number of paintballs have gathered in the opening in the rotor arm member.

19. The paintball loader according to claim 1 further comprising a controller configured to cut off power to the drive motor when a predetermined level of force is exerted on the rotor arm member by one or more paintballs in the first direction.

20. The paintball loader according to claim 19, wherein the predetermined level of force necessary to cut off power to the drive motor is selectable.

21. The paintball loader according to claim 1 further comprising a rapid feed lid member having a plurality of resilient flap members, the flap members being configured to move between a first position and a second position so that paintballs are inhibited from exiting the loader between the flap members.

22. The paintball loader according to claim 1, wherein the opening connects to a passageway extending through the loader, at least a portion of the passageway being coaxially aligned with the axis of rotation of the rotor arm member.

23. The paintball loader according to claim 1, wherein the drive motor is configured to rotate the rotor member in a first direction and the rotor arm member in a second direction, the first direction being opposite the second direction.

24. A paintball loader comprising:

a housing;

a rotor member having at least one rotor fin configured to rotate about an axis;

a rotor arm member having an opening and being configured to rotate about substantially the same axis;

a rotor base member and a planetary gear assembly comprising a first gear and a plurality of second gears, wherein rotation of the rotor base member rotates the rotor member and the plurality of second gears, and wherein the plurality of second gears rotate the rotor arm member; and a ramp member supported within the housing and being configured to move from a first position to a second position.

25. The paintball loader according to claim 24, wherein the first position is a down position and the second position is an up position.

26. The paintball loader according to claim 24, wherein at least a portion of the ramp member contacts one or more paintballs.

27. The paintball loader according to claim 24, wherein the ramp member moves from the first position to the second position as one or more paintballs exit the loader.

28. The paintball loader according to claim 24, wherein the ramp member has a planar shape.

29. The paintball loader according to claim 24 further comprising a spring, the spring biasing the ramp member toward the second position.

30. The paintball loader according to claim 24 further comprising a first body member and a second body member, the first body member being secured to the second body member without separate fasteners.

31. The paintball loader according to claim 30 further comprising a latch member for selectively securing the second body member to the first body member.

32. The paintball loader according to claim 24, wherein the ramp member is disposed separately from the rotor base member.

33. A paintball loader for feeding one or more paintballs into a paintball marker, the loader comprising:

a housing, at least a portion of the housing having an opening through which the one or more paintballs are fed to the paintball marker;

a rotor member having a plurality of rotor fins configured to rotate about an axis;

a rotor arm member being configured to rotate about substantially the same axis, at least a portion of the rotor arm member being disposed above the opening and below the rotor member;

a drive motor configured to rotate the rotor member and the rotor arm member; and a rotor base member and a planetary gear assembly comprising a first gear and a plurality of second gears, wherein rotation of the rotor base member rotates the rotor member and the plurality of second gears, and wherein the plurality of second gears rotate the rotor arm member.

* * * * *